US009126091B2

(12) United States Patent
Hou

(10) Patent No.: US 9,126,091 B2
(45) **Date of Patent: *Sep. 8, 2015**

(54) SIMPLIFIED GOLF CLUB SWING TRAINING APPARATUS

(71) Applicant: Wen-Sun Hou, Westlake Village, CA (US)

(72) Inventor: Wen-Sun Hou, Westlake Village, CA (US)

(73) Assignee: BEST SWING ONE, LLC, Westlake Village, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/193,960

(22) Filed: Feb. 28, 2014

(65) Prior Publication Data

US 2014/0248970 A1 Sep. 4, 2014

Related U.S. Application Data

(63) Continuation-in-part of application No. 13/783,034, filed on Mar. 1, 2013, now Pat. No. 8,915,793.

(51) Int. Cl.

| | |
|---|---|
| ***A63B 59/00*** | (2015.01) |
| ***A63B 69/36*** | (2006.01) |
| ***A63B 15/00*** | (2006.01) |

(Continued)

(52) U.S. Cl.

CPC ..... *A63B 69/3635* (2013.01); *A63B 15/00* (2013.01); *A63B 53/10* (2013.01); *A63B 53/145* (2013.01); *A63B 59/0033* (2013.01); *A63B 69/3623* (2013.01); *A63B 2059/0081* (2013.01); *A63B 2071/0602* (2013.01); *A63B 2071/0625* (2013.01); *A63B 2071/0655* (2013.01); *Y10T 29/49817* (2015.01)

(58) Field of Classification Search

CPC .. A63B 15/00; A63B 53/145; A63B 69/3623; A63B 53/10; A63B 2071/0655; A63B 2071/0625; A63B 69/3635; A63B 2071/0602; A63B 2059/0081; A63B 59/0033; Y10T 29/49817

USPC ..... 473/232–234, 226, 294, 296, 316, 324, 473/409, 219, 239, 422, 297, 238; 29/426.2

See application file for complete search history.

(56) References Cited

U.S. PATENT DOCUMENTS

| | | | |
|---|---|---|---|
| 695,579 | A | 3/1902 | Parmele |
| 1,428,015 | A | 9/1922 | Dienner |

(Continued)

OTHER PUBLICATIONS

Passaniti, S., U.S. Office Action, U.S. Appl. No. 13/783,034, pp. 1-7.

*Primary Examiner* — Sebastiano Passaniti

(74) *Attorney, Agent, or Firm* — Lyon & Harr, LLP; Richard T. Lyon

(57) ABSTRACT

A golf club swing training apparatus and a method for fabricating it are provided. The apparatus includes a golf club shaft and a slide mechanism. The shaft includes an upper portion and a lower portion that are spaced apart to form a gap there-between. The slide mechanism is inserted within this gap and is connected to the lower end of the upper shaft portion and the upper end of the lower shaft portion. The slide mechanism includes an upper connector, a sliding rail, a rail guide block, and a lower connector that are configured to permit a lateral shift of this lower portion relative to this upper portion during a swinging of the club. The method uses an axial alignment apparatus to maintain the elongated axis of the upper shaft portion in substantial alignment with the elongated axis of the lower shaft portion when the slide mechanism is being connected.

22 Claims, 24 Drawing Sheets

(51) Int. Cl.

| | |
|---|---|
| ***A63B 53/10*** | (2015.01) |
| ***A63B 53/14*** | (2015.01) |
| *A63B 71/06* | (2006.01) |

(56) References Cited

U.S. PATENT DOCUMENTS

| | | | | |
|---|---|---|---|---|
| 1,529,305 | A | 3/1925 | Gatke | |
| 3,180,308 | A | 4/1965 | Carroli et al. | |
| 3,341,203 | A | 9/1967 | Brill | |
| 3,953,035 | A | 4/1976 | Beckisk | |
| 4,027,886 | A | 6/1977 | Katsube | |
| 4,145,054 | A | 3/1979 | Stewart | |
| 4,576,378 | A | 3/1986 | Backus | |
| 4,614,343 | A | 9/1986 | Radway | |
| 4,854,585 | A | 8/1989 | Koch et al. | |
| 4,932,661 | A | 6/1990 | Choi | |
| 4,969,921 | A | 11/1990 | Silvera | |
| 5,026,064 | A | 6/1991 | Novosel | |
| 5,037,103 | A | 8/1991 | Williams et al. | |
| 5,082,283 | A | 1/1992 | Conley et al. | |
| 5,143,376 | A | 9/1992 | Johnson | |
| 5,195,748 | A | 3/1993 | Koch et al. | |
| 5,226,652 | A | 7/1993 | Sato | |
| 5,277,427 | A | 1/1994 | Bryan et al. | |
| 5,372,557 | A | 12/1994 | Ostigny | |
| 5,415,406 | A | 5/1995 | Reichenbach et al. | |
| 5,467,993 | A | 11/1995 | Higginson | |
| 5,527,039 | A | 6/1996 | Levesque | |
| 5,580,321 | A | 12/1996 | Rennhack | |
| 5,588,920 | A | 12/1996 | Soong | |
| 5,616,087 | A | 4/1997 | Bothwell | |
| 5,700,205 | A | 12/1997 | Sanford | |
| 5,735,752 | A | 4/1998 | Antonious | |
| 5,860,871 | A | 1/1999 | Marley, Jr. | |
| 5,941,779 | A | 8/1999 | Zeiner-Gundersen | |
| 6,012,988 | A | 1/2000 | Burke | |
| 6,059,668 | A | 5/2000 | Marley, Jr. | |
| 6,071,199 | A | 6/2000 | Suzuki | |
| 6,257,992 | B1 | 7/2001 | LeBlanc | |
| 6,358,157 | B1 | 3/2002 | Sorenson | |
| 6,440,005 | B1 | 8/2002 | Hubenig | |
| 6,881,156 | B1 | 4/2005 | Phillips | |
| 7,018,302 | B2 | 3/2006 | Jacoby | |
| 7,041,000 | B1 | 5/2006 | Galloway | |
| 7,074,133 | B1 | 7/2006 | Jones et al. | |
| 7,285,055 | B2 | 10/2007 | Radle | |
| 7,416,492 | B2 | 8/2008 | Wesley | |
| 7,455,595 | B1 | 11/2008 | Gibbons et al. | |
| 7,481,716 | B1 * | 1/2009 | Johnson | 473/297 |
| 8,348,779 | B2 | 1/2013 | Kim | |
| 8,915,793 | B2 * | 12/2014 | Hou | 473/232 |
| 2006/0122000 | A1 | 6/2006 | Paredes et al. | |
| 2007/0275788 | A1 | 11/2007 | Delpine | |
| 2010/0167830 | A1 | 7/2010 | Hinton et al. | |
| 2012/0064986 | A1 | 3/2012 | Brooks | |
| 2013/0267340 | A1 | 10/2013 | Wolf | |

* cited by examiner

SIMPLIFIED GOLF CLUB SWING TRAINING APPARATUS

CROSS REFERENCE TO RELATED APPLICATION

This application is a continuation-in-part of U.S. patent application Ser. No. 13/783,034 filed Mar. 1, 2013, the disclosure of which is hereby incorporated by reference.

BACKGROUND

Golfers are always looking for ways to improve their scores. As a result, many different kinds of training devices have been disclosed in issued U.S. patents for improving various aspects of a golfer's skills. Some such training devices are specifically configured to improve a golfer's swing so that he or she hits a golf ball longer or straighter or more accurately. Normally, such training devices are designed to be used at a hitting range where repeated use of the device will produce muscle memory or other physical effect to alter the golfer's swing for better using conventional golf clubs during an actual round of golf.

SUMMARY

This Summary is provided to introduce a selection of concepts, in a simplified form, that are further described hereafter in the Detailed Description. This Summary is not intended to identify key features or essential features of the claimed subject matter, nor is it intended to be used as an aid in determining the scope of the claimed subject matter.

Training apparatus embodiments described herein generally involve a golf club swing training apparatus. In one exemplary embodiment the training apparatus includes a golf club shaft and a slide mechanism. The shaft has a butt end and a head end, and includes two separate and distinct portions that are spaced apart to form a gap there-between, where these portions include an upper shaft portion that includes the butt end of the shaft and a lower shaft portion that includes the head end of the shaft. A ball striking head is connected to the head end of the shaft. The slide mechanism is inserted within this gap and is connected to the lower end of the upper shaft portion and the upper end of the lower shaft portion. The slide mechanism includes an upper connector, a sliding rail, a rail guide block, and a lower connector that are configured to permit a lateral shift of the upper end of the lower shaft portion relative to the lower end of the upper shaft portion during a swinging of the club.

In another exemplary embodiment the lower connector of the training apparatus includes a rail travel distance limiting screw that is adapted to permit a golfer to selectively reduce a maximum rail travel distance to which the just-described lateral shift is limited.

The training apparatus embodiments described herein also involve a method for fabricating the training apparatus. In an exemplary embodiment of this method a golf club is provided that includes a shaft having a butt end and a head end, where the head end of the shaft is affixed to a ball striking head. The shaft is then cut into the aforementioned two portions. A length of shaft is then removed from at least one of these two portions. An axial alignment apparatus is then used to connect these two portions to opposing connectors of the slide mechanism. The axial alignment apparatus maintains the elongated axis of the upper shaft portion in substantial alignment with the elongated axis of the lower shaft portion when the connection to the slide mechanism is being made. The slide mechanism is configured to permit the upper end of the lower shaft portion to shift laterally relative to the lower end of the upper shaft portion during a swinging of the club to impact a ball with the ball striking head.

DESCRIPTION OF THE DRAWINGS

The aforementioned objects and advantages of the present invention (herein also referred to as training apparatus embodiments), as well as additional objects and advantages thereof, will be more fully understood herein after as a result of a detailed description of preferred embodiments when taken in conjunction with the following drawings in which:

FIG. 47 also illustrates how the rail travel distance limiter is bolted to the rail guide block of FIG. 8 using screws.

DETAILED DESCRIPTION

Figure 1:
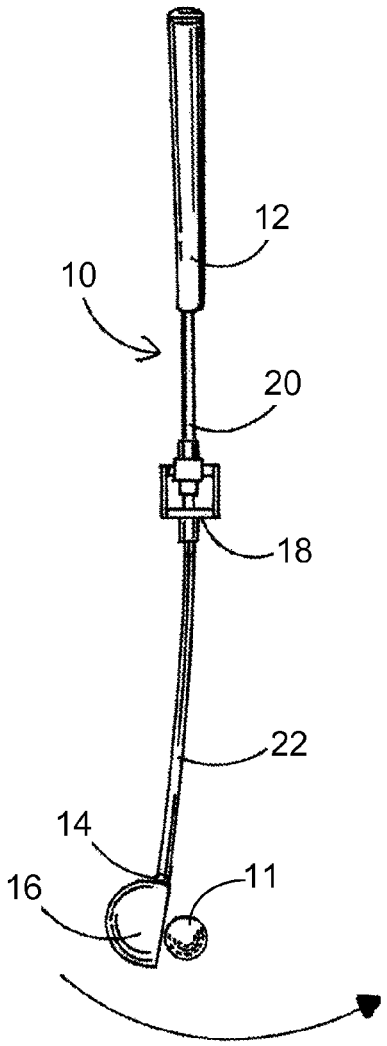
FIGS. 1 and 2 are diagrams illustrating an exemplary embodiment of the general shape of the training golf club hereof at impact with a golf ball under two distinct conditions providing two alternative trajectories, one for left to right curvature and the other for right to left curvature.

In the following description of the present invention (hereafter referred to as training apparatus embodiments) reference is made to the accompanying drawings which form a part hereof, and in which are shown, by way of illustration, specific embodiments in which the training apparatus can be practiced. It is understood that other embodiments can be utilized and structural changes can be made without departing from the scope of the training apparatus embodiments.

It is also noted that for the sake of clarity specific terminology will be resorted to in describing the training apparatus embodiments described herein and it is not intended for these embodiments to be limited to the specific terms so chosen. Furthermore, it is to be understood that each specific term includes all its technical equivalents that operate in a broadly similar manner to achieve a similar purpose. Reference herein to "one embodiment", or "another embodiment", or an "exemplary embodiment", or an "alternate embodiment", or "one implementation", or "another implementation", or an "exemplary implementation", or an "alternate implementation" means that a particular feature, a particular structure, or particular characteristics described in connection with the embodiment or implementation can be included in at least one embodiment of the training apparatus. The appearances of the phrases "in one embodiment", "in another embodiment", "in an exemplary embodiment", "in an alternate embodiment", "in one implementation", "in another implementation", "in an exemplary implementation", and "in an alternate implementation" in various places in the specification are not necessarily all referring to the same embodiment or implementation, nor are separate or alternative embodiments/implementations mutually exclusive of other embodiments/implementations. Yet furthermore, the order of process flow representing one or more embodiments or implementations of the training apparatus does not inherently indicate any particular order not imply any limitations of the training apparatus.

The training apparatus embodiments described herein relate generally to the field of golf clubs and more particularly to a golf club training device for improving a golfer's swing. In a disclosed embodiment, a golf club shaft is cut transversely along its length, a portion is removed, and an offset slide mechanism is inserted at the cut to enable a lower portion of the shaft to move transversely relative to an upper portion of the shaft during a desired swing. The natural flexibility of a golf club shaft is employed to shape a properly hit golf ball trajectory to selectively curve the ball, either left to right, or right to left. The training device hereof teaches a golfer to swing a golf club in a manner that exploits the momentum of the golf club head to achieve the desired ball trajectory shape. In other words, the training device hereof is specifically configured to improve a golfer's ability to selectively shape the ball's trajectory so that the ball moves right to left or left to right in a controlled manner. As will be appreciated from the more detailed description that follows, the slide mechanism that is inserted in-between the upper and lower portions of the cut shaft permits one such portion to be moved laterally relative to the other such portion by forces incurred during a preferred swing.

1.0 Golf Club Swing Training Apparatus

As will now be described in more detail, the training apparatus embodiments described herein involve a golf club swing training apparatus designed to help golfers learn to selectively control a golf ball trajectory shape so that the ball is made to "bend" from right to left, or left to right. The apparatus is configured as an otherwise conventional golf club such as a driver (among other types of golf clubs), but wherein the shaft is spliced at a location along its length between the butt end and the head end of the shaft. After removing a short piece of shaft to retain the overall length of the club, a slide mechanism is inserted to mate with the shaft's upper and lower portions. The slide mechanism permits limited transverse movement of the lower portion that is connected to the golf club head relative to the upper portion that includes the butt end or grip of the club. This motion is substantially in a direction that is orthogonal to the elongated axis of the shaft and in the preferred embodiment hereof, is limited to a maximum travel of about 0.25 inches. The motion will occur during successful use of the training device, that is, during a proper swing for achieving the desired control of ball trajectory shape. The desired motion of the slide mechanism is normally heard and felt by the golfer during the swing so that he or she has both audible and tactile feedback through the golf club training device indicating that a desired swing profile has been achieved.

Turning to the accompanying drawings, it will be seen in FIG. 1 that the training apparatus embodiments described herein involve a golf club 10 which has a shaft 12 connected by a hosel 14 to a head 16. However, unlike any other golf club, the training apparatus embodiments employ a slide mechanism 18 which has been interposed into the shaft 12 between an upper portion 20 and a lower portion 22 so that mechanism 18 interconnects those two portions 20 and 22. In the particular embodiment shown in FIG. 1, the golf club 10 is a driver club and the slide mechanism 18 has been interposed about two-fifths of the way down the length of the club including the head 16. So for example, in a driver having an overall length of 45 inches, the slide mechanism 18 would be at about 18 inches from the butt end of the shaft 12. The shaft would typically be cut through at that location in a direction that is substantially perpendicular to the axis of the shaft. The slide mechanism is then connected in-between the resulting upper and lower portions of the shaft after removing a short piece of shaft from the lower portion to accommodate the approximate two inch length of the slide mechanism to retain the overall length of the club. The location of the shaft splice is preferably selected to be at or near the maximum bend point or apex of the shaft which may vary with the length and type of golf club. Therefore, in a shorter club such as a 3-wood or 2-iron, the splice point might be somewhat closer to the butt end.

Figure 2:
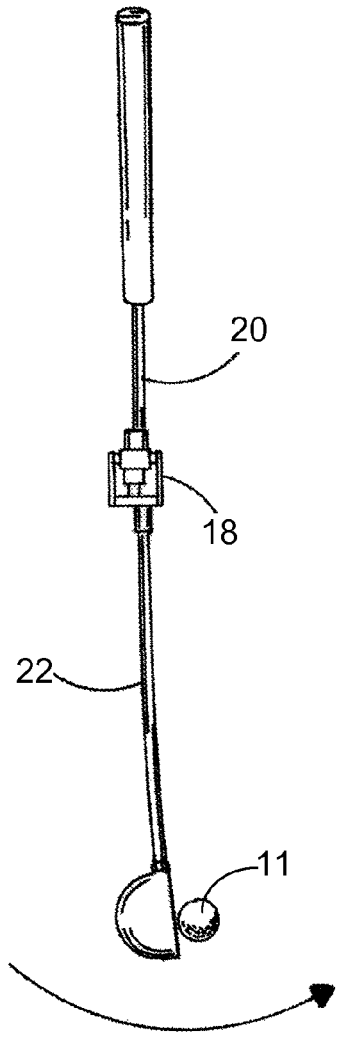
Figure 3:
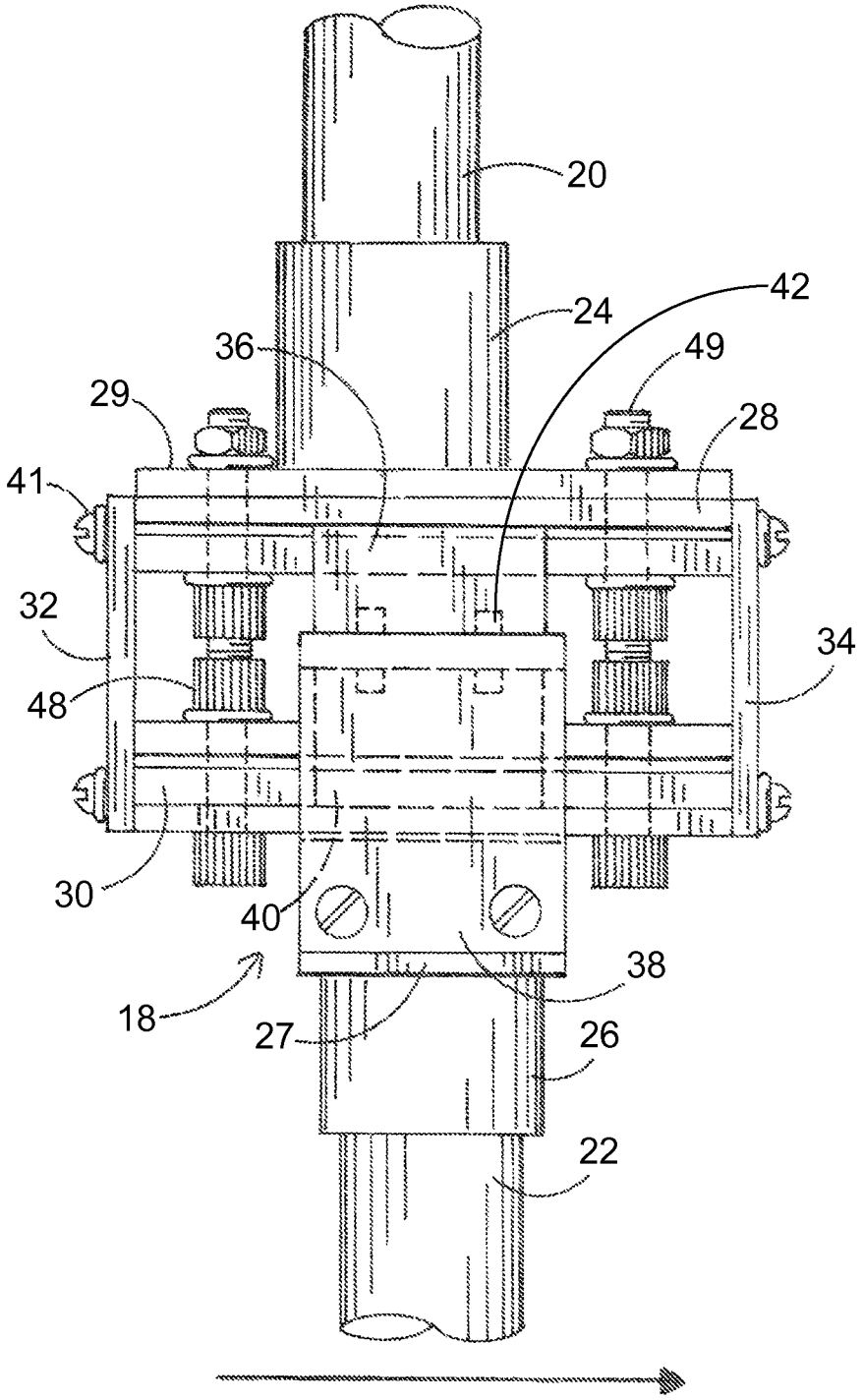
FIG. 3 is a diagram illustrating a plan view of one embodiment of a slide mechanism shown inserted into a golf club shaft according to the embodiment of FIG. 2.

Slide mechanism 18 is best understood by referring to FIGS. 3-7. As shown in FIG. 3, when fully assembled and connected, slide mechanism 18 permits low friction lateral movement of lower shaft portion 22 relative to upper shaft portion 20. Connectors 24 and 26 are adhesively connected to respective shaft portions 20 and 22 so that they may be axially aligned to be perfectly co-axial. However, depending upon the forces incurred during a full swing such as to impact a tee-supported golf ball 11 as shown in FIGS. 1 and 2, lower shaft portion 22 may slide or shift transversely to up to about 0.25 inches to produce an off-axis position to advance the head toward the ball 11 at impact (as shown in FIG. 2). Such shift will result in a right to left trajectory profile when the head face is square at ball 11 impact. On the other hand, when the golfer controls his or her swing to prevent such a shift of lower portion 22, the two portions remain substantially co-axial, and the head impacts the ball 11 behind the shaft axis (as shown in FIG. 1) resulting in a left to right trajectory shape with a square face at impact.

Figure 4:
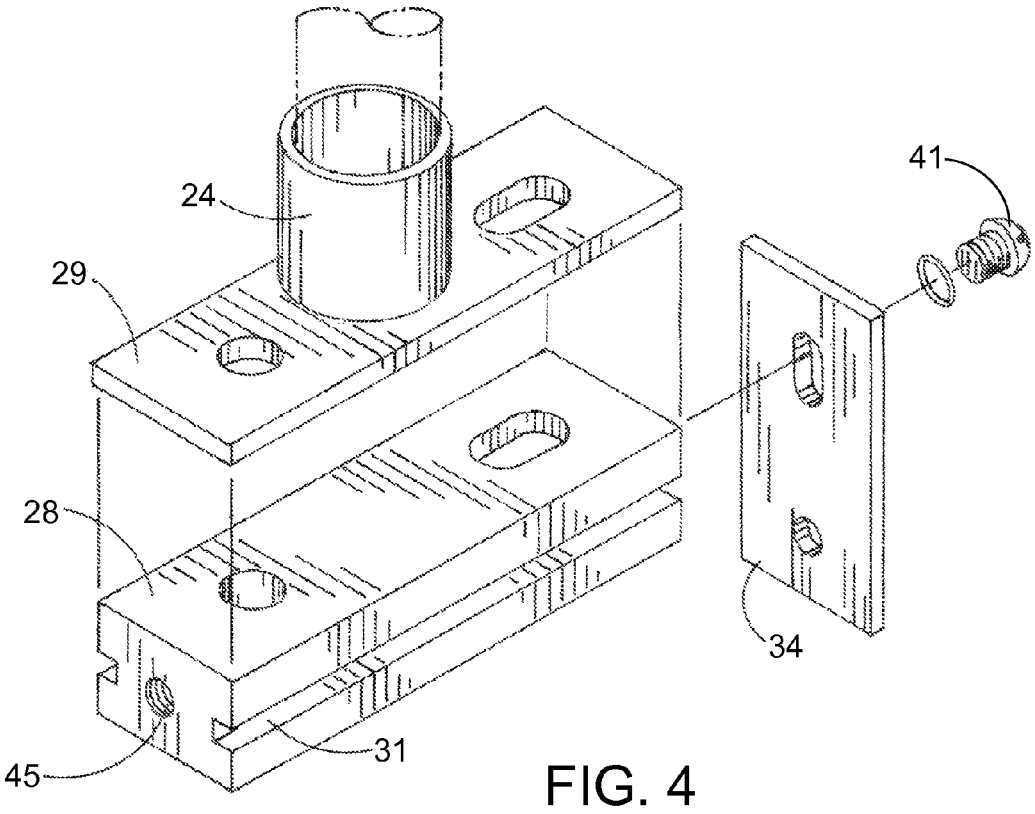
FIGS. 4 through 7 are diagrams illustrating three-dimensional drawings of exemplary embodiments of various components of the slide mechanism of FIG. 3.
Figure 5:
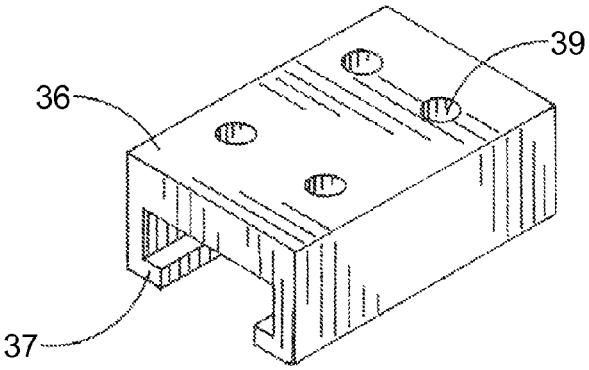
Figure 6:
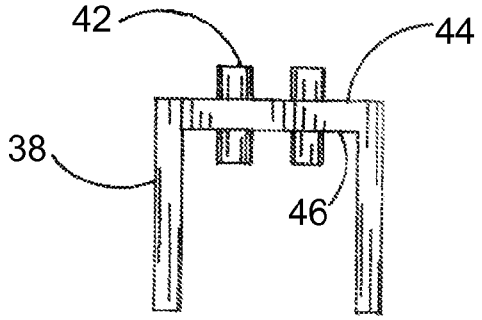
Figure 7:
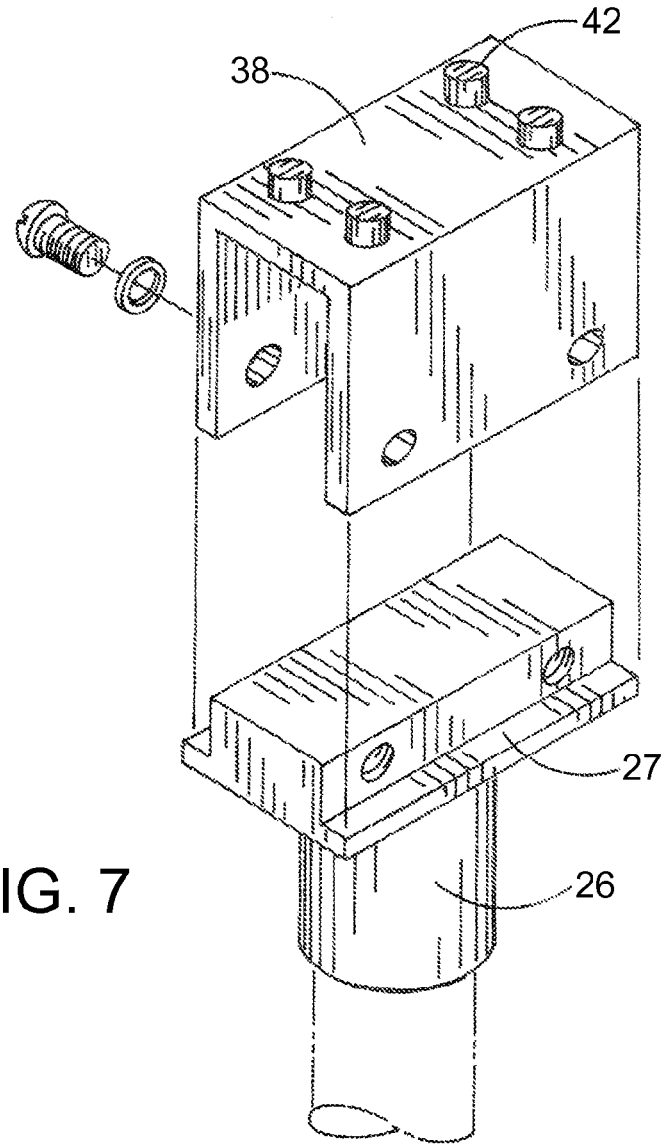

Returning to FIGS. 3-7, it is seen that the disclosed slide embodiment 18 further includes an interface 27, slide rails 28 and 30, rail interface plate 29, rail stabilizers 32 and 34, linear guide blocks 36 and 40 and a yoke 38. As shown in FIG. 4, each slide rail 28 and 30 has an elongated rail slot 31 which receives a rail travel flange 37 (see FIG. 5) in sliding engagement. Yoke 38, seen in FIGS. 3, 6 and 7, provides a plurality of vertical, cylindrical probes 42 on opposing surfaces 44 and 46. These probes 42 permit a stable mechanical interface with linear guide blocks 36 and 40 by mating with aligned block holes 39 shown in FIG. 5. Upper linear guide block 36 has its holes 39 directed down and lower linear guide block 40 has its holes directed up as viewed in FIG. 3 so that they each mate in opposing directions with yoke 38 and thus slide together as one unit along parallel and spaced apart rails 28 and 30. Further, the distance between slide rails 28 and 30 is adjustable using knobs 48 and set with fasteners 49 that compress the slide rails toward one another with the yoke 38 therebetween. This dual rail assembly provides strong mechanical resistance to bending and possible breakage during the swing with even the highest likely club head speed. Finally, mechanical strength and uniform slide motion is assured by virtue of the rail stabilizers 32 and 34 which are bolted by screws 41 into respective threaded apertures 45 at the respective ends of the slide rails as shown in FIG. 4. The completely assembled slide mechanism 18 permits limited sliding of the lower shaft portion 22 relative to the upper shaft portion 20 over a selected short distance (i.e., 0.25 inches) with substantial mechanical integrity.

It will now be understood that by practicing with the swing training club of the training apparatus embodiments described herein, a golfer will learn how to control and alter the swing to produce a desired ball trajectory profile of either right to left or left to right. Moreover, it will be appreciated that the slide mechanism embodiments described herein may produce a sudden shift of the lower portion of the shaft which generates both a sound and a tactile impact to let the golfer know whether and when such a shift or slide has occurred during the swing and to change swing mechanisms to either produce a shift or prevent a shift as desired for a selected trajectory.

It is noted that the training golf club exemplified in FIGS. 1 and 2 is a right-handed golf club that is being swung by the golfer in a left-to-right manner, where the lower shaft portion 22 is permitted to slide or shift transversely rightward relative to the upper shaft portion 20 when the right-handed golf club is swung in a left-to-right manner. The training apparatus embodiments described herein are also compatible with left-handed golf clubs that are swung in a right-to-left manner. More particularly, the slide mechanism embodiments described herein can also be interposed into the shaft of any left-handed golf club. In this case and with exemplary reference to the slide mechanism 18 shown in FIGS. 1-3, the slide mechanism would be rotated 180 degrees about the longitudinal axes of connectors 24 and 26 so that the lower shaft portion is permitted to slide or shift transversely leftward relative to the upper shaft portion when the left-handed golf club is swung in a right-to-left manner.

2.0 Modified Slide Mechanism

Figure 8:
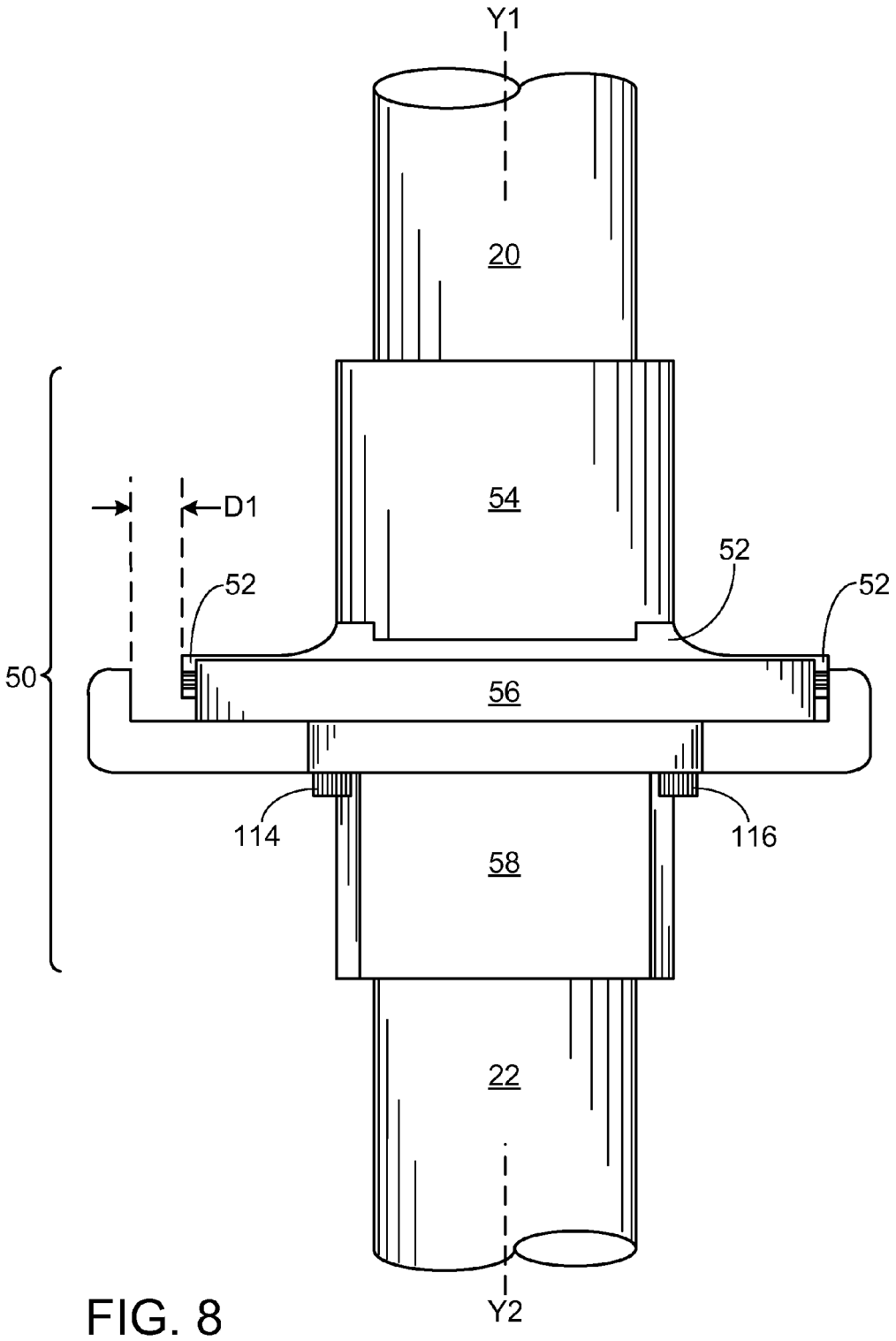
FIG. 8 is a diagram illustrating a plan view, in simplified form, of another embodiment of the slide mechanism shown inserted in-between the lower end of an upper portion of the golf club shaft and the upper end of a lower portion of the golf club shaft, where a sliding rail of the slide mechanism is situated in a right-most position such that these lower and upper ends are substantially coaxial.
Figure 9:
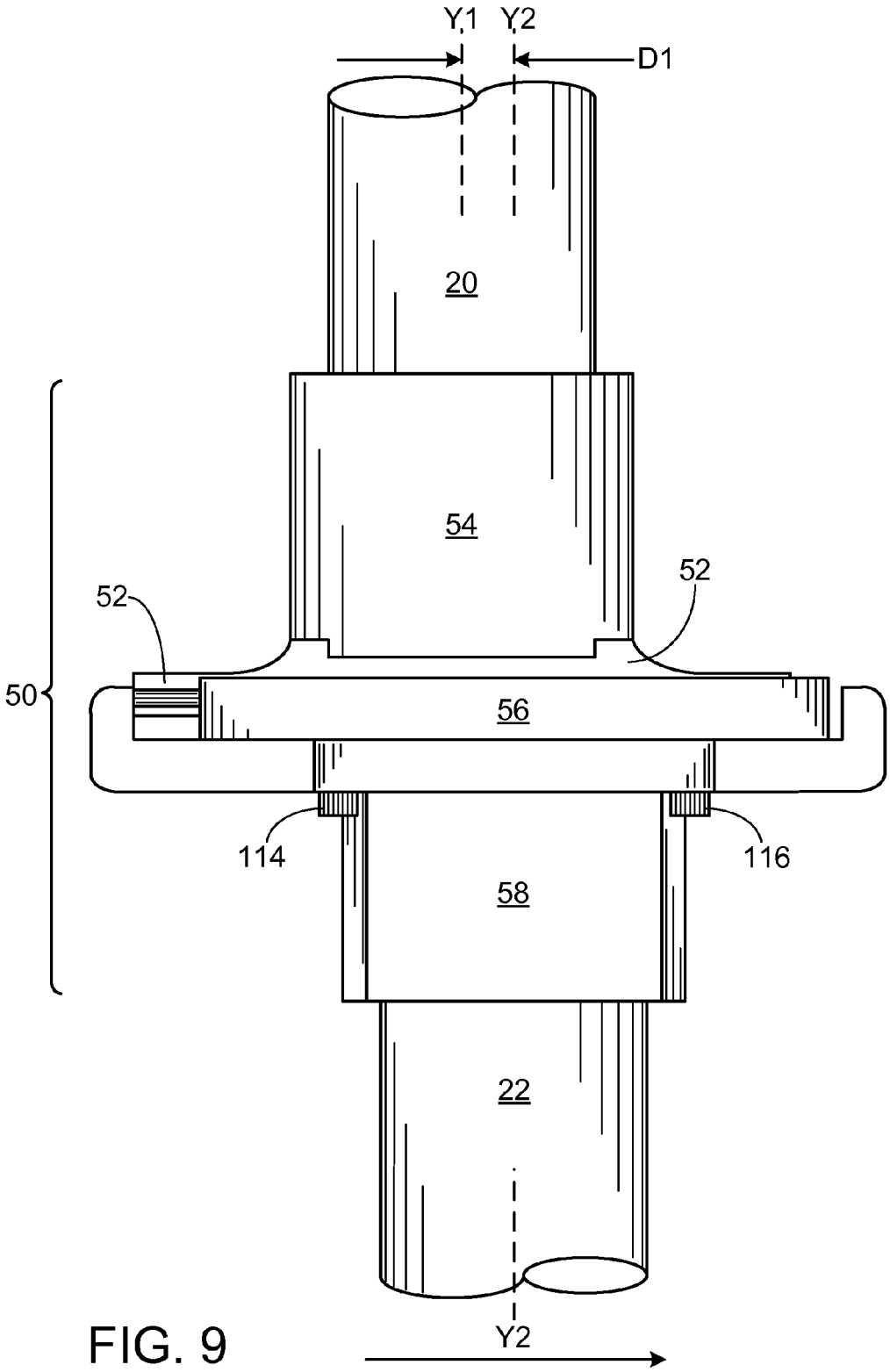
FIG. 9 is a diagram illustrating a plan view, in simplified form, of the slide mechanism of FIG. 8 where the sliding rail of the slide mechanism is situated in a left-most position such that the upper end of the lower portion of the golf club shaft is transversely offset a prescribed distance from the lower end of the upper portion of the golf club shaft.
Figure 10:
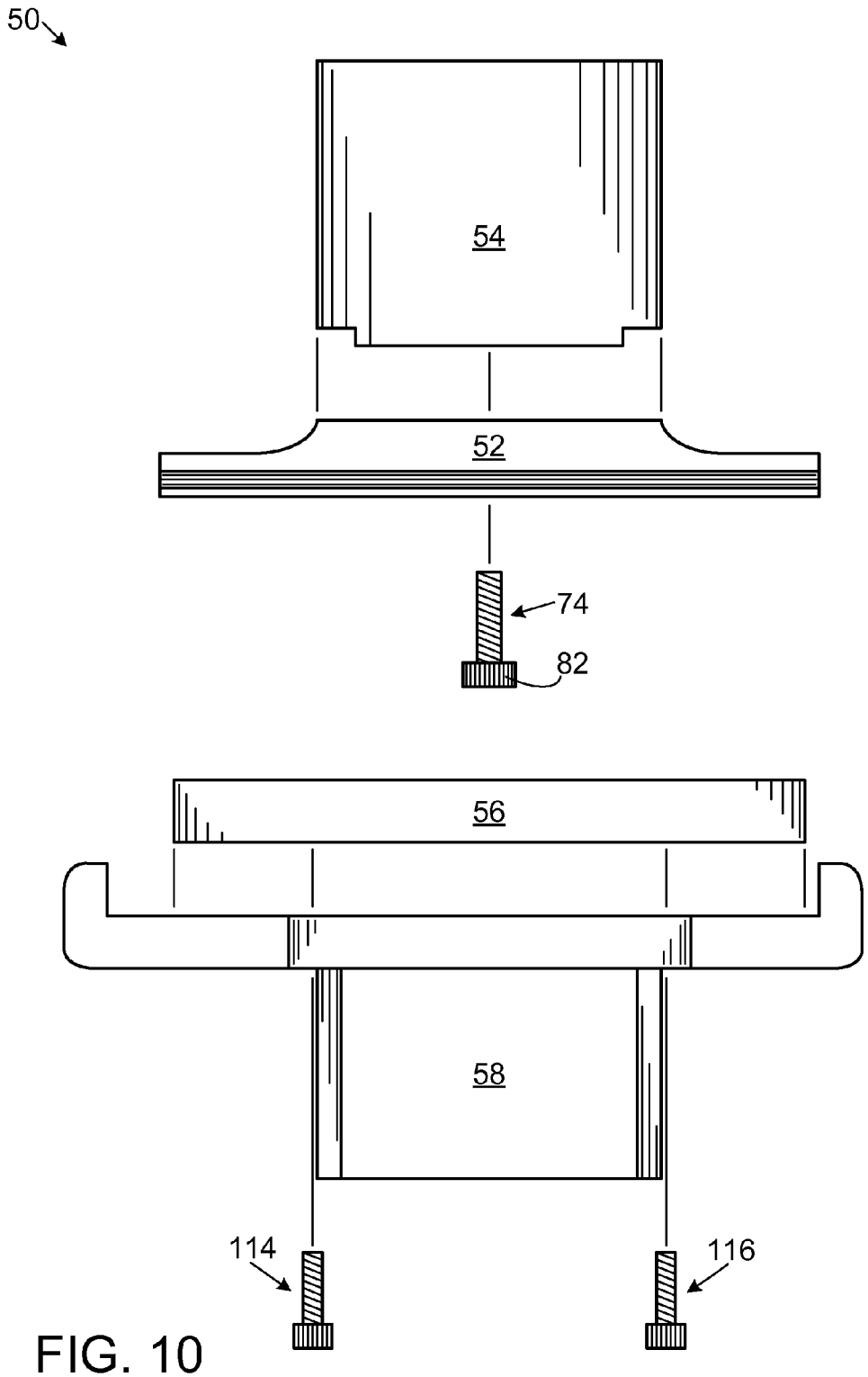
FIG. 10 is a diagram illustrating an exploded plan view, in simplified form, of the slide mechanism of FIG. 8.

FIGS. 8-14 and 19-29 illustrate another embodiment, in simplified form, of the slide mechanism of the training apparatus embodiments described herein. More particularly, FIG. 8 illustrates a plan view, in simplified form, of an exemplary embodiment of a modified slide mechanism 50 that is shown inserted in-between the lower end of an upper portion 20 of the golf club shaft and the upper end of a lower portion 22 of the golf club shaft. As exemplified in FIG. 8, the modified slide mechanism 50 includes an upper connector 54, a sliding rail 52, a rail guide block 56, and a lower connector 58. The sliding rail 52 of the modified slide mechanism 50 shown in FIG. 8 is situated in a right-most position such that the longitudinal axis Y1 of the lower end of the upper portion 20 of the golf club shaft is substantially aligned with the longitudinal axis Y2 of the upper end of the lower portion 22 of the golf club shaft (e.g., these lower and upper ends are substantially coaxial when the sliding rail 52 is situated in the right-most position). As will be appreciated from the more detailed description of the modified slide mechanism 50 that follows, the momentum of the golfer's backswing will cause the rail guide block 56, the lower connector 58, and the upper end of the lower portion 22 of the golf club shaft to naturally move to this right-most position. FIG. 9 illustrates a plan view, in simplified form, of the modified slide mechanism 50 where the sliding rail 52 is situated in a left-most position such that the longitudinal axis Y2 of the upper end of the lower portion 22 of the golf club shaft is transversely offset a prescribed maximum rail travel distance D1 from the longitudinal axis Y1 of the lower end of the upper portion 20 of the golf club shaft. FIG. 10 illustrates an exploded plan view, in simplified form, of the modified slide mechanism 50. It is noted that the size of the maximum rail travel distance D1 and the related difference between lengths L1 and L2 (which are described in more detail hereafter) shown in the accompanying drawings are exaggerated in order to make them more visible.

As will be appreciated from FIGS. 8-14 and 19-29 and the more detailed description of these FIGs. that follows, the design of the modified slide mechanism 50 is significantly simpler than the design of the slide mechanism 18 exemplified in FIG. 3 and described heretofore (e.g., modified slide mechanism 50 has significantly fewer parts than slide mechanism 18). The design of the modified slide mechanism 50 is also advantageous since it minimizes the weight of the mechanism while maximizing its structural integrity, and provides strong mechanical resistance to bending and possible breakage during the swing of the golf club with even the highest likely club head speed. As exemplified in FIGS. 8 and 9, when the modified slide mechanism 50 is completely assembled and connected to the upper and lower portions 20 and 22 of the golf club shaft, the modified slide mechanism 50 permits limited, low-friction, transverse movement of the upper end of the lower portion 22 of the golf club shaft relative to the lower end of the upper portion 20 of the golf club shaft with substantial mechanical integrity. In other words the modified slide mechanism 50 permits low-friction, lateral movement (e.g., a lateral shift/sliding) of this upper end 22 relative to this lower end 20 during a swinging of the golf club toward a golf ball, where this lateral movement/motion/shift is confined to a direction that is substantially orthogonal to both the longitudinal axis Y2 of this upper end 22 and the longitudinal axis Y1 of this lower end 20, and this lateral movement/motion/shift is limited to the maximum rail travel distance D1.

Figure 11:
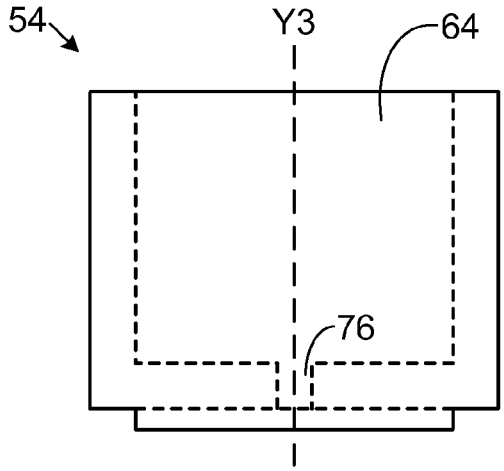
FIG. 11 is a diagram illustrating a standalone transparent plan view, in simplified form, of one embodiment of an upper connector of the slide mechanism of FIG. 8.
Figure 12:
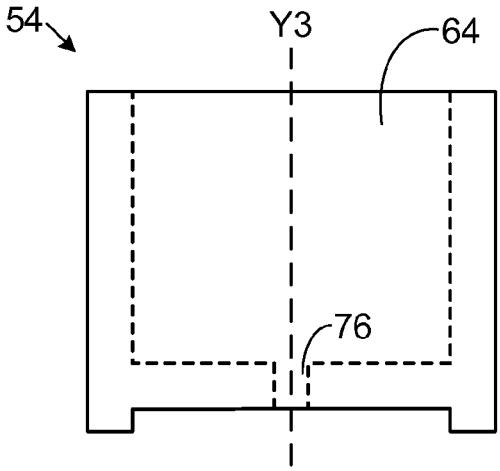
FIG. 12 is a diagram illustrating a transparent plan view, in simplified form, of the upper connector of FIG. 11 rotated left 90 degrees.
Figure 13:
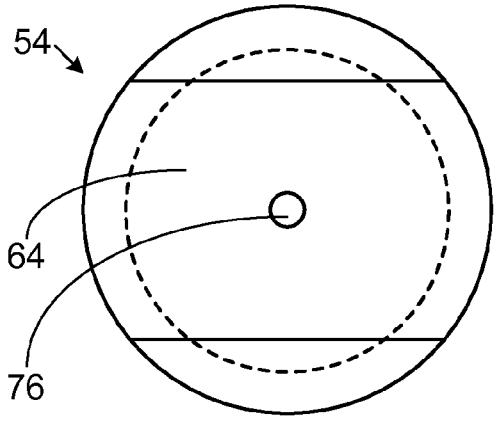
FIG. 13 is a diagram illustrating a transparent bottom view, in simplified form, of the upper connector of FIG. 11.
Figure 14:
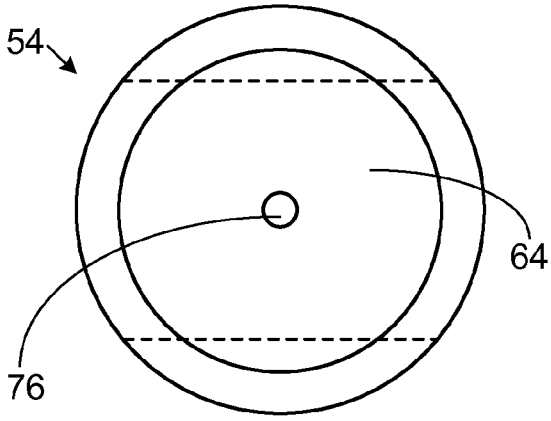
FIG. 14 is a diagram illustrating a transparent top view, in simplified form, of the upper connector of FIG. 11.
Figure 19:
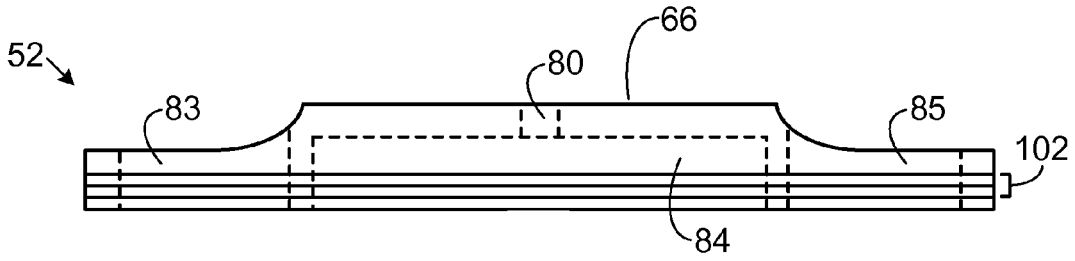
FIG. 19 is a diagram illustrating a standalone transparent plan view, in simplified form, of an exemplary embodiment of a sliding rail of the slide mechanism of FIG. 8.
Figure 20:
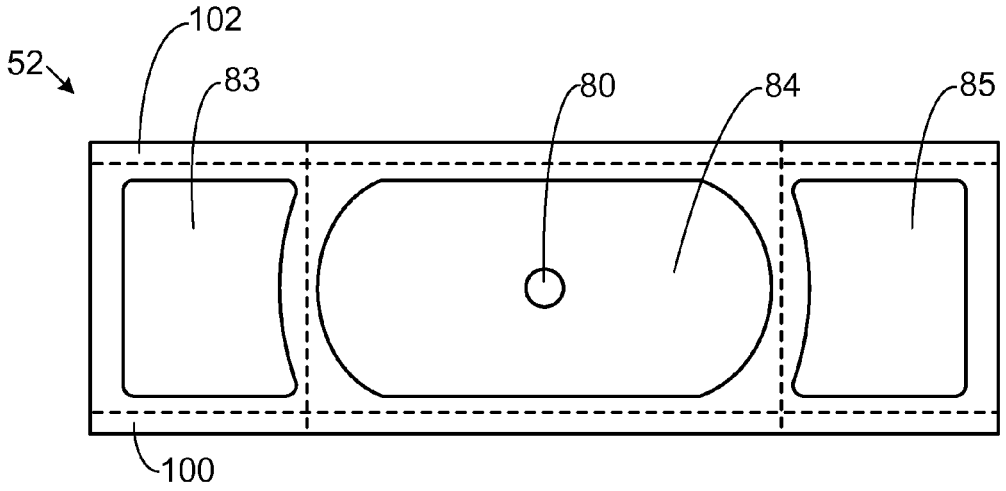
FIG. 20 is a diagram illustrating a transparent bottom view, in simplified form, of the sliding rail of FIG. 19.
Figure 21:
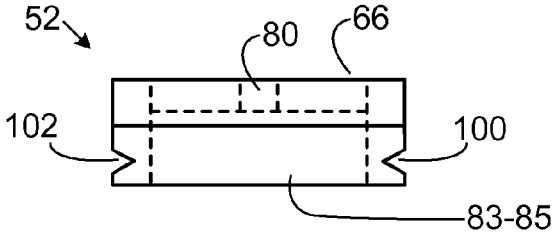
FIG. 21 is a diagram illustrating a transparent plan view, in simplified form, of the sliding rail of FIG. 19 rotated left 90 degrees.
Figure 22:
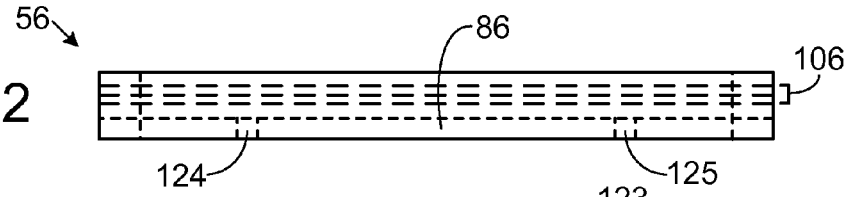
FIG. 22 is a diagram illustrating a standalone transparent plan view, in simplified form, of an exemplary embodiment of a rail guide block of the slide mechanism of FIG. 8.
Figure 23:
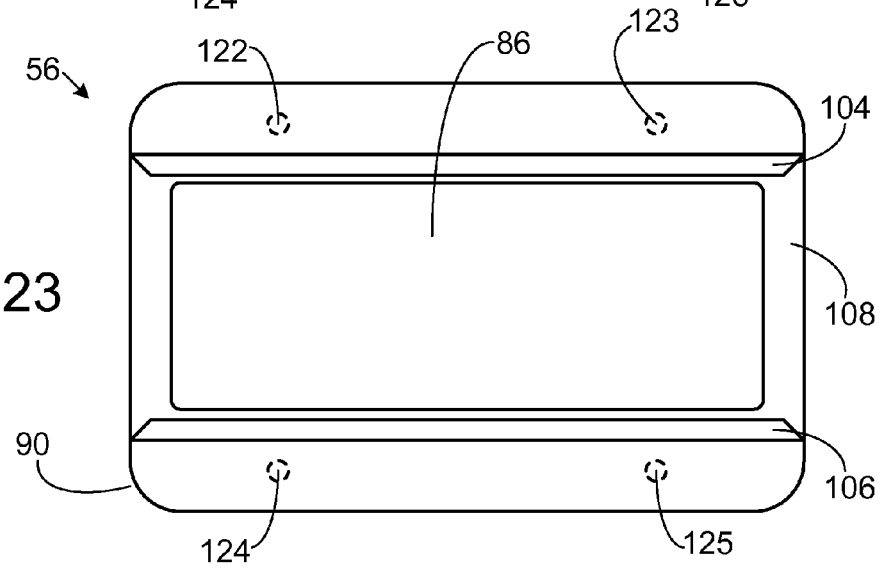
FIG. 23 is a diagram illustrating a transparent top view, in simplified form, of the rail guide block of FIG. 22.
Figure 24:
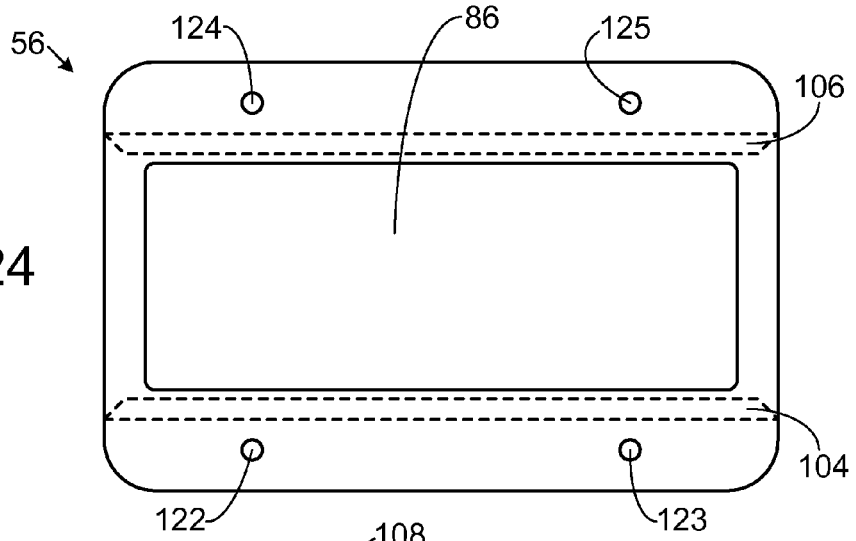
FIG. 24 is a diagram illustrating a transparent bottom view, in simplified form, of the rail guide block of FIG. 22.
Figure 25:
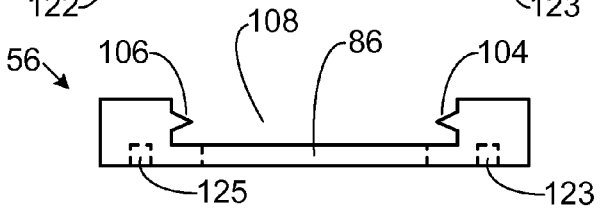
FIG. 25 is a diagram illustrating a transparent plan view, in simplified form, of the rail guide block of FIG. 22 rotated left 90 degrees.
Figure 26:
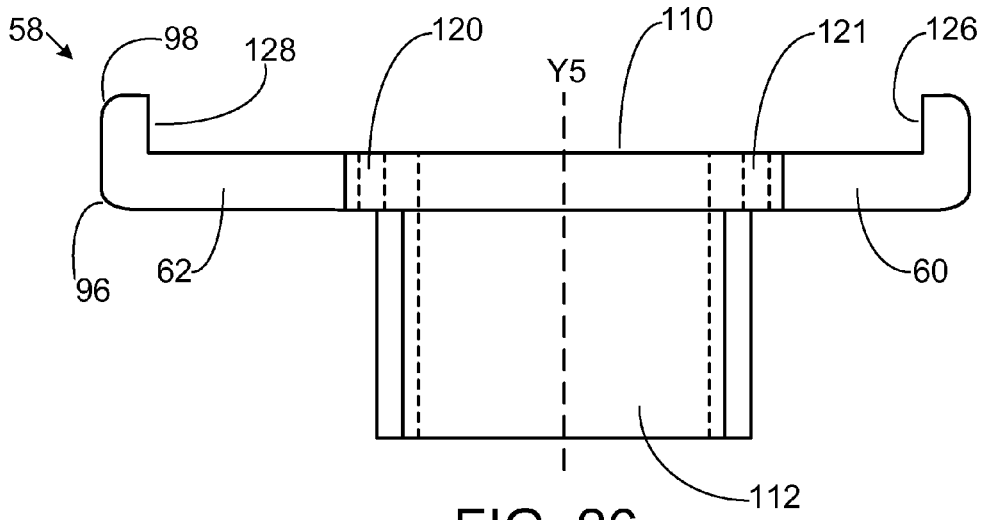
FIG. 26 is a diagram illustrating a standalone transparent plan view, in simplified form, of one embodiment of a lower connector of the slide mechanism of FIG. 8.
Figure 27:
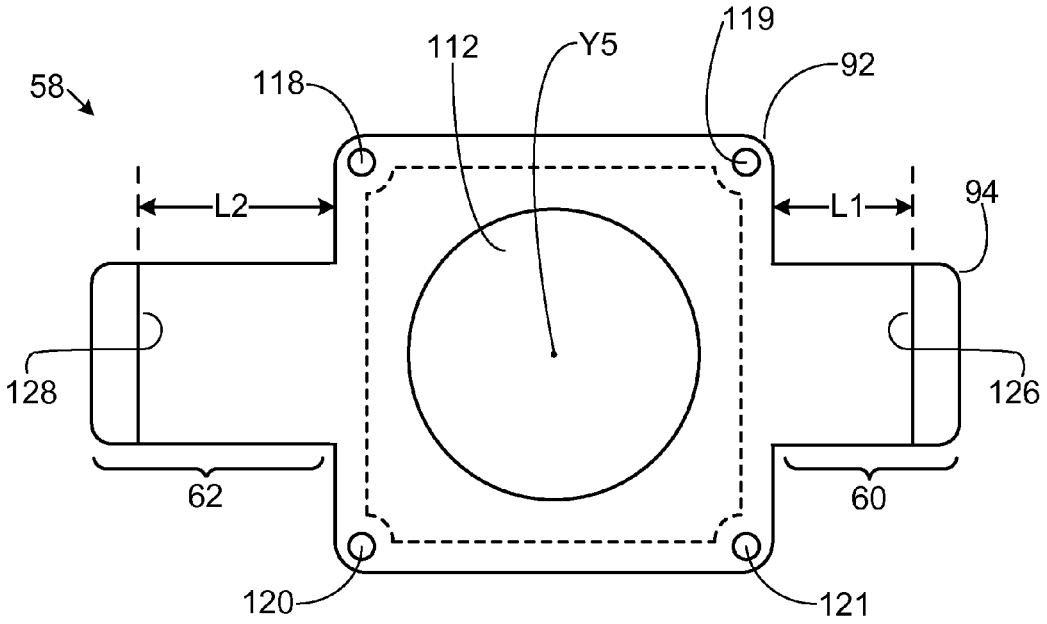
FIG. 27 is a diagram illustrating a transparent top view, in simplified form, of the lower connector of FIG. 26.
Figure 28:
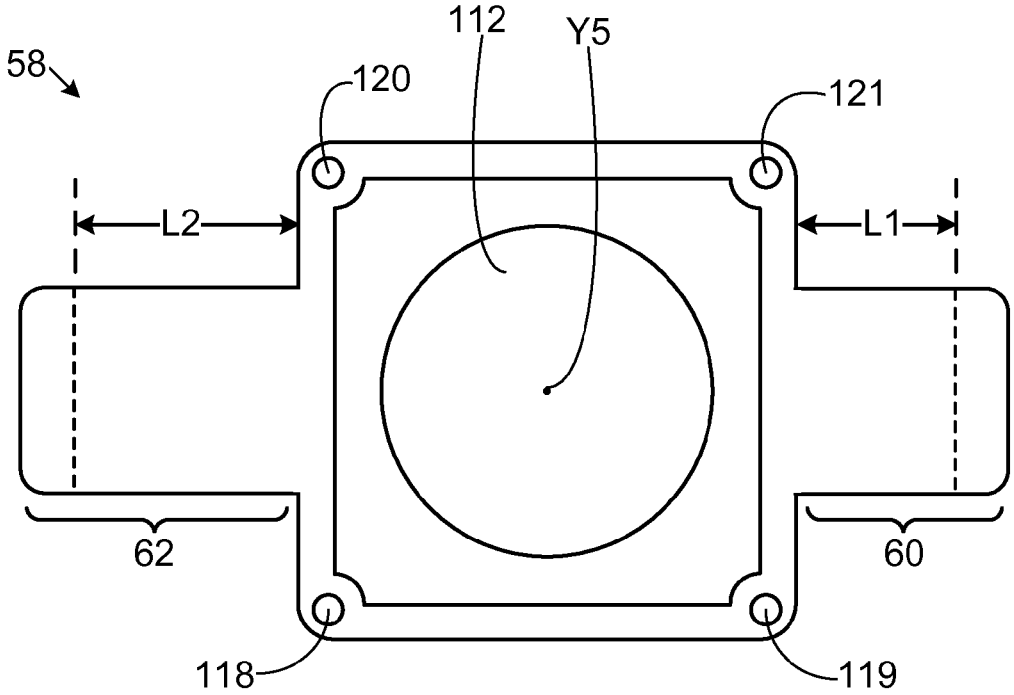
FIG. 28 is a diagram illustrating a transparent bottom view, in simplified form, of the lower connector of FIG. 26.
Figure 29:
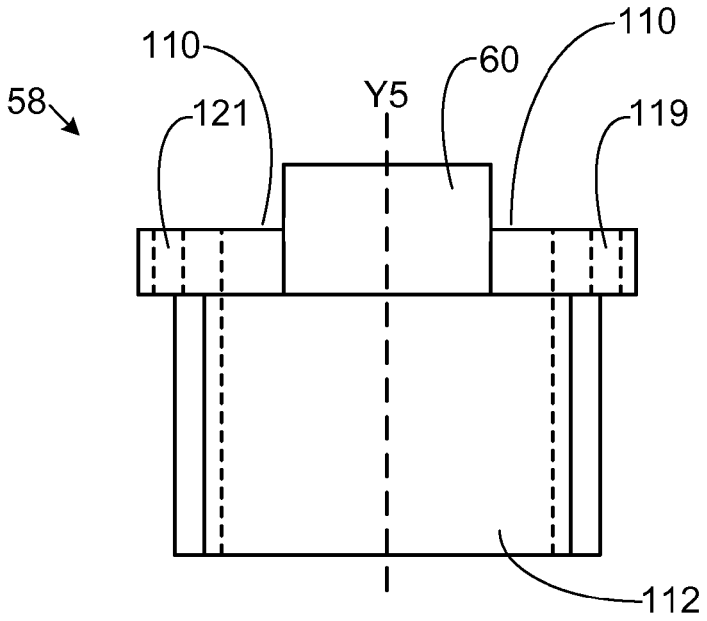
FIG. 29 is a diagram illustrating a transparent plan view, in simplified form, of the lower connector of FIG. 26 rotated left 90 degrees.

FIG. 11 illustrates a standalone transparent plan view, in simplified form, of one embodiment of the upper connector 54 of the modified slide mechanism 50 of FIG. 8. FIG. 12 illustrates a transparent plan view, in simplified form, of the upper connector 54 of FIG. 11 rotated left 90 degrees. FIG. 13 illustrates a transparent bottom view, in simplified form, of the upper connector 54 of FIG. 11. FIG. 14 illustrates a transparent top view, in simplified form, of the upper connector 54 of FIG. 11. FIG. 19 illustrates a standalone transparent plan view, in simplified form, of an exemplary embodiment of the sliding rail 52 of the modified slide mechanism 50 of FIG. 8. FIG. 20 illustrates a transparent bottom view, in simplified form, of the sliding rail 52 of FIG. 19. FIG. 21 illustrates a transparent plan view, in simplified form, of the sliding rail 52 of FIG. 19 rotated left 90 degrees. FIG. 22 illustrates a standalone transparent plan view, in simplified form, of an exemplary embodiment of the rail guide block 56 of the modified slide mechanism 50 of FIG. 8. FIG. 23 illustrates a transparent top view, in simplified form, of the rail guide block 56 of FIG. 22. FIG. 24 illustrates a transparent bottom view, in simplified form, of the rail guide block 56 of FIG. 22. FIG. 25 illustrates a transparent plan view, in simplified form, of the rail guide block 56 of FIG. 22 rotated left 90 degrees. FIG. 26 illustrates a standalone transparent plan view, in simplified form, of one embodiment of the lower connector 58 of the modified slide mechanism 50 of FIG. 8. FIG. 27 illustrates a transparent top view, in simplified form, of the lower connector 58 of FIG. 26. FIG. 28 illustrates a transparent bottom view, in simplified form, of the lower connector 58 of FIG. 26. FIG. 29 illustrates a transparent plan view, in simplified form, of the lower connector 58 of FIG. 26 rotated left 90 degrees.

As exemplified in FIGS. 8-14, the upper portion of the upper connector 54 is adapted to permit the lower end of the upper portion 20 of the golf club shaft to be rigidly connected to the top of the connector 54 in a manner that insures this lower end 20 is substantially coaxial with the connector 54. In the upper connector embodiment exemplified in FIGS. 11-14 this adaptation is configured as follows. The top end of the upper connector 54 includes a cylindrical cavity 64 that is substantially coaxial with the connector 54. This cavity 64 has a diameter that is sized to permit the lower end of the upper portion 20 to be snugly inserted downward into the cavity 64 while a strong adhesive is used to rigidly adhere the radially outer surface of this lower end 20 to the radial wall of the cavity 64. It will be appreciated that various types of adhesive can be used. In an exemplary implementation of the modified slide mechanism 50 the adhesive is an epoxy.

As exemplified in FIGS. 8-14 and 19-21, the lower portion of the upper connector 54 is adapted to permit it to be rigidly connected to a central position on the top surface 66 of the sliding rail 52 in a manner that insures the longitudinal axis Y3 of the cylindrical cavity 64 is substantially perpendicular to the surface 66, thus insuring that the longitudinal axis of the lower end of the upper portion 20 is substantially perpendicular to the surface 66 when this lower end is connected to the top of the connector 54. In the exemplary upper connector and sliding rail embodiments described herein this adaptation is configured as follows. The sliding rail 52 is bolted by a screw 74 that is inserted through an aperture 80 that passes horizontally through the sliding rail 52 and into a mating threaded aperture 76 that is located on the bottom of the upper connector 54. As exemplified in FIGS. 19-21, an elongated cavity 84 having rounded opposing walls is centrally located on the bottom end of the sliding rail 52, where the aperture 80 passes through the approximate center of the cavity 84. The cavity 84 serves to reduce the weight of the modified slide mechanism 50, and has a height and an overall volume that are sufficient to permit the head 82 of the screw 74 to become recessed beneath the bottom surface of the sliding rail 52 when the screw 74 is fully tightened into the mating threaded aperture 76.

As exemplified in FIGS. 8, 9, and 19-25, the lower portion of the sliding rail 52 includes a pair of opposing elongated rail slots 100 and 102. The upper portion of the rail guide block 56 includes a linear guide channel 108 having parallel vertical sidewalls and a pair of opposing rail travel features 104 and 106, where one of the rail travel features 104 is disposed onto one of the sidewalls of the channel 108 and the other of the rail travel features 106 is disposed onto the other of the sidewalls of the channel 108. The elongated rail slot 100 is adapted to mate with the mating rail travel feature 104, and the elongated rail slot 102 is adapted to mate with the mating rail travel feature 106. Accordingly, the pair of opposing elongated rail slots 100 and 102 is adapted to receive the pair of opposing rail travel features 104 and 106 in low-friction sliding engagement when the sliding rail 52 is slidably inserted into the linear guide channel 108 of the rail guide block 56.

As exemplified in FIGS. 8-10 and 22-29, the lower portion of the rail guide block 56 is adapted to permit it to be rigidly connected to the center top surface 110 of the lower connector 58 in a manner that insures the longitudinal axis Y5 of a cylindrical cavity 112 that is located on the bottom end of the lower connector 58 (and thus the elongated axis of the upper end of the lower portion 22 of the golf club shaft that is inserted into this cavity 112) is substantially perpendicular to the opposing rail travel features 104 and 106. In the exemplary rail guide block and lower connector embodiments described herein this adaptation is configured as follows. The lower connector 58 is bolted by a plurality of screws (e.g., 114 and 116) that are inserted through apertures 118-121 that pass horizontally through the lower connector 58 and into mating threaded apertures 122-125 that are located on the bottom of the rail guide block 56. As will be appreciated from FIGS. 8 and 9 and the functional operation of the modified slide mechanism 50 described heretofore, the lower connector 58 is not bolted to the rail guide block 56 until after the sliding rail 52 has been slidably inserted into the linear guide channel 108 of the block 56.

Referring again to FIGS. 8-10 and 26-29, the upper portion of the lower connector 58 includes a pair of opposing rail travel distance limiting features 60 and 62 that are adapted to limit the travel of the sliding rail 52 (e.g., limit the aforementioned lateral shift) to the maximum rail travel distance D1. In the exemplary lower connector embodiments described herein this adaptation is configured as follows. The lower connector 58 includes a right-side rail travel distance limiting feature 60 having a prescribed length L1 and a left-side rail travel distance limiting feature 62 having a prescribed length L2 that is greater than length L1. As will be appreciated from FIGS. 8 and 9, the difference between length L2 and length L1 defines the maximum rail travel distance D1. When the sliding rail 52 is situated in the aforementioned right-most position the right side of the sliding rail makes contact with an inner vertical wall 126 of the right-side rail travel distance limiting feature 60. When the sliding rail 52 is situated in the aforementioned left-most position the left side of the sliding rail 52 makes contact with an inner vertical wall 128 of the left-side rail travel distance limiting feature 62. Generally speaking, lengths L1 and L2 can be selected so that the distance D1 can have any value, where this value is selected based on the stiffness of the shaft. By way of example but not limitation, in one implementation of the modified slide mechanism 50 lengths L1 and L2 are selected so that the distance D1 is approximately 0.25 inches. In another implementation of the modified slide mechanism 50 lengths L1 and L2 are selected so that the distance D1 is between 0.55 millimeters and 0.75 millimeters.

Referring again to FIGS. 8-10 and 26-29, the lower portion of the lower connector 58 is adapted to permit the upper end of the lower portion 22 of the golf club shaft to be rigidly connected to the bottom of the connector 58 in a manner that insures the elongated axis of this upper end 22 is substantially perpendicular to the center top surface 110 of the connector 58. In the lower connector embodiment exemplified in FIGS. 26-29 this adaptation is configured as follows. The bottom end of the lower connector 58 includes the cylindrical cavity 112 that has the longitudinal axis Y5 that is substantially perpendicular to the center top surface 110 of the connector 58. This cavity 112 has a diameter that is sized to permit the upper end of the lower portion 22 to be snugly inserted either upward or downward into the cavity 112 while the aforementioned strong adhesive is used to rigidly adhere the radially outer surface of this upper end 22 to the radial wall of the cavity 112. It is noted that the diameter of the cavity 112 will typically be slightly smaller than the diameter of the cavity 64 since the diameter of the upper end of the lower portion 22 of a conventional golf club shaft is slightly smaller than the diameter of the lower end of the upper portion 20 of the shaft.

As exemplified in FIGS. 19-21 and referring again to FIG. 8, the sliding rail 52 can optionally include one or more weight-reducing apertures 83 and 85 that serve to further reduce the weight of the modified slide mechanism 50. These apertures 83 and 85 and the elongated cavity 84 are sized to be as large as possible without negatively affecting the structural integrity of the sliding rail 52. Similarly, as exemplified in FIGS. 22-25, the rail guide block 56 can optionally include another weight-reducing aperture 86 that serves to further reduce the weight of the modified slide mechanism 50. This aperture 86 is sized to be as large as possible without negatively affecting the structural integrity of the rail guide block 56. As exemplified in FIGS. 8-10, 23, 26 and 27 (among other places), the exterior corners on the modified slide mechanism 50 can be rounded in order to prevent injury to the golfer and yet further reduce the weight of the modified slide mechanism 50. By way of example but not limitation, the four exterior corners (e.g., corner 90) on the rail guide block 56 are rounded. The 12 exterior corners (e.g., corners 92, 94, 96 and 98) on the lower connector 58 are also rounded.

Referring again to FIGS. 8 and 22-25, it will be appreciated that the rail guide block 56 can be implemented in various ways. In an exemplary implementation of the modified slide mechanism 50 the block of a commercially available miniature linear guide product (part number CPC-MR7WL, manufactured by Chieftek Precision Company, Ltd.) is used for the rail guide block 56, where the weight-reducing aperture 86 can optionally be added to this commercially available block. In this particular implementation each of the mating rail travel features 104 and 106 includes a re-circulating train of lubricated, miniature, stainless steel ball bearings.

Given the forgoing, it will further be appreciated that the modified slide mechanism embodiments described herein can be interposed into the golf club shaft at any desired location along the shaft. The decision of which location along the shaft the aforementioned cut is to be made and the modified slide mechanism embodiments are to be interposed involves the consideration of various factors including, but not limited to, the following. Locating the modified slide mechanism closer to the grip on the butt end of the shaft maximizes the flex in the lower portion of the shaft when the club is swung which is advantageous. However, the inherent weight of the modified slide mechanism embodiments can also change the balance point of the club which is disadvantageous, where the degree of this change depends on the actual weight of the mechanism and the particular location along the shaft where the mechanism is interposed. In an exemplary implementation of the modified slide mechanism embodiments where the golf club is a driver club having a graphite shaft and an overall length of approximately 45 inches, the aforementioned gap into which the modified slide mechanism is inserted is located at a distance from the butt end of the shaft of about 30 percent of the total length of the club (including the head of the club).

Referring again to FIGS. 1, 2, 8, 9 and 26, similar to the slide mechanism 18, the design of the modified slide mechanism 50 is further advantageous since it permits the golfer to hear and feel the desired motion of the modified slide mechanism 50 during their swing of the golf club 10. In other words, when the modified slide mechanism 50 is interposed into the golf club shaft as described heretofore, the mechanism 50 provides the golfer with both audible and tactile feedback indicating whether or not they have achieved a desired swing profile. For example, when the golf club is swung in a manner that makes the upper end of the lower portion 22 of the golf club shaft laterally shift rightward relative to the lower end of the upper portion 20 of the golf club shaft such that the sliding rail 52 reaches the aforementioned left-most position and the left side of the sliding rail 52 impacts the inner vertical wall 128 of the left-side rail travel distance limiting feature 62 of the lower connector 58, the modified slide mechanism 50 will generate a discernible sound (e.g., the golfer will hear a "click" sound) and will also generate a tactile sensation at the butt end of the shaft (e.g., the golfer will feel a vibration that travels from the modified slide mechanism 50 through the upper portion 20 and into their hands).

Figure 46:
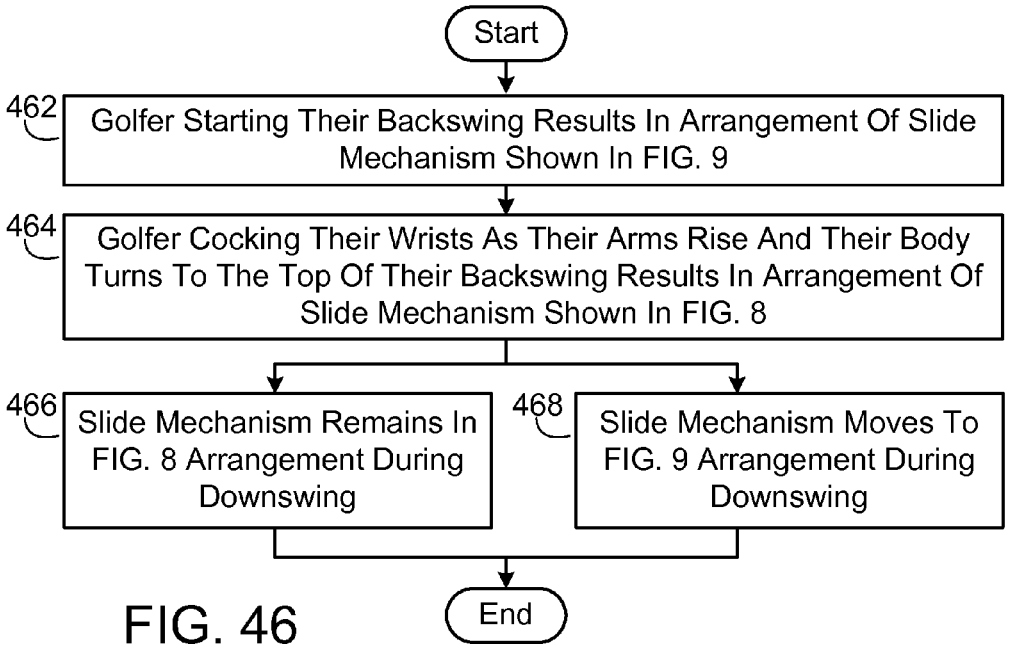
FIG. 46 is a flow diagram illustrating an exemplary embodiment, in simplified form, of a method for operating the golf club swing training apparatus described herein.

FIG. 46 illustrates an exemplary embodiment, in simplified form, of a method for operating the golf club swing training apparatus described herein. Although this method is described in the context of the modified slide mechanism 50 embodiments described herein being interposed into the golf club shaft, this method also applies to the slide mechanism 18 embodiments described herein being interposed into the shaft. As exemplified in FIG. 46 and referring again to FIGS. 8 and 9, as the golfer starts their backswing the sliding rail 52 of the modified slide mechanism 50 will be situated in the left-most position such that the longitudinal axis Y2 of the upper end of the lower portion 22 of the shaft is transversely offset the maximum rail travel distance D1 from the longitudinal axis Y1 of the lower end of the upper portion 20 of the shaft as shown in FIG. 9 (action 462). When the golfer cocks their wrists as their arms rise and their body turns to the top of their backswing the sliding rail 52 of the modified slide mechanism 50 will be situated in the right-most position such that the longitudinal axis Y2 of the upper end of the lower portion 22 of the shaft is substantially aligned with the longitudinal axis Y1 of the lower end of the upper portion 20 of the shaft as shown in FIG. 8 (action 464). Then, depending on how the golfer performs their downswing to impact the ball with the ball striking head, during the downswing the modified slide mechanism 50 will either remain in the arrangement shown in FIG. 8 (action 466), or move to the arrangement shown in FIG. 9 (action 468).

2.1 Convertible Slide Mechanism

This section describes an alternate embodiment of the modified slide mechanism described herein that can be converted at will by the golfer into a non-sliding mechanism which maintains the upper end of the lower portion of the golf club shaft in substantial coaxial alignment with the lower end of the upper portion of the shaft at all times regardless of how the golfer swings the club. The alternate embodiment described in this section is hereafter simply referred to as the convertible slide mechanism embodiment.

Figure 47:
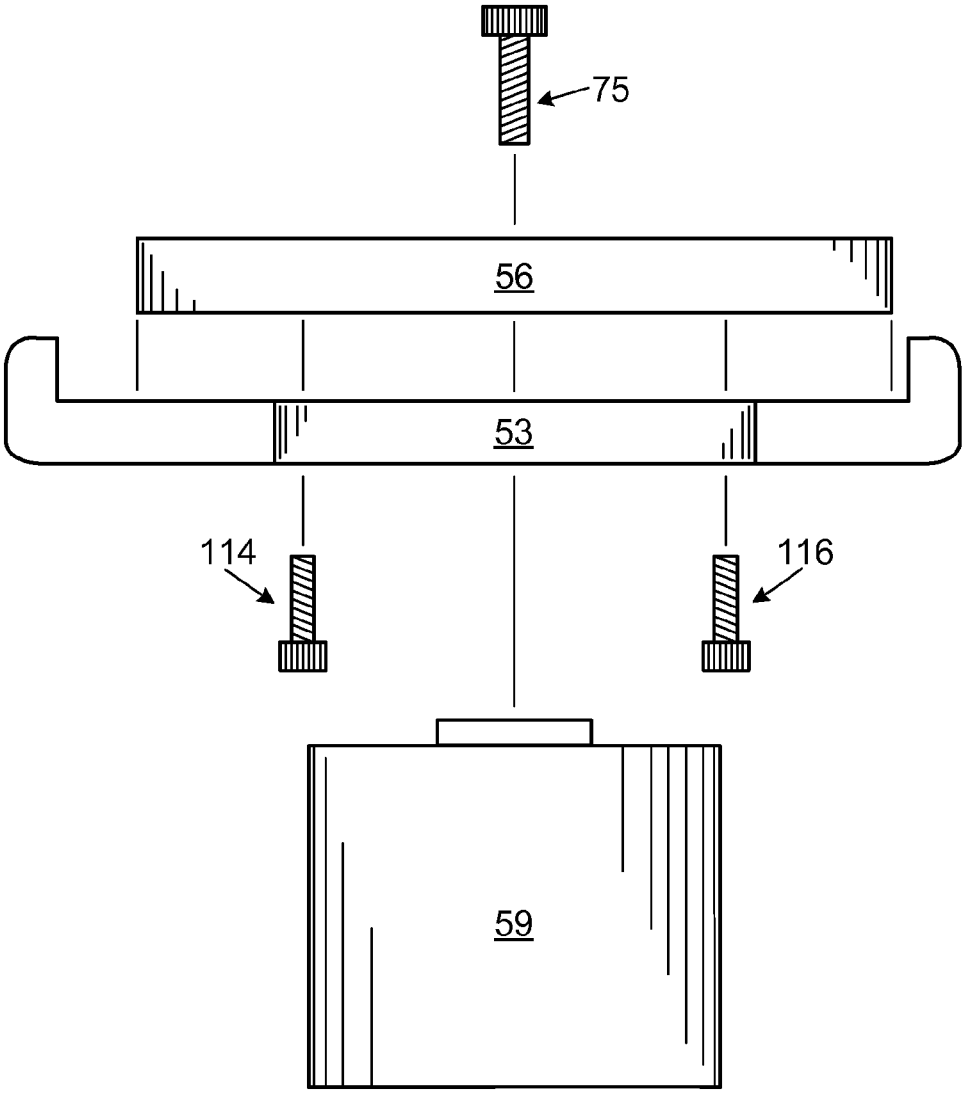
FIG. 47 is a diagram illustrating an exploded plan view, in simplified form, of yet another embodiment of the lower connector of the slide mechanism of FIG. 8 that is made up of three separate components, namely a rail travel distance limiter and a lower shaft portion connector that are bolted together using a screw.
Figure 48:
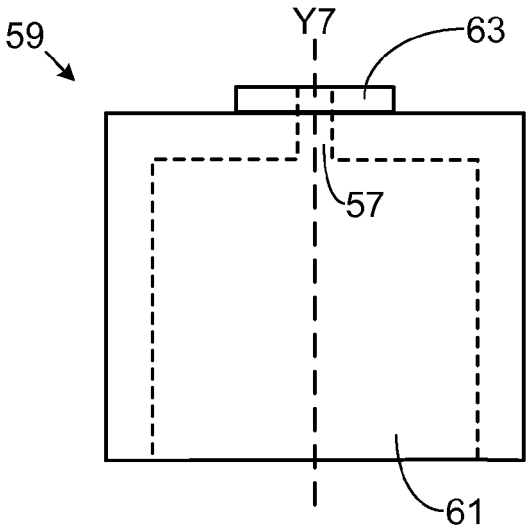
FIG. 48 is a diagram illustrating a standalone transparent plan view, in simplified form, of the lower shaft portion connector of FIG. 47.
Figure 49:
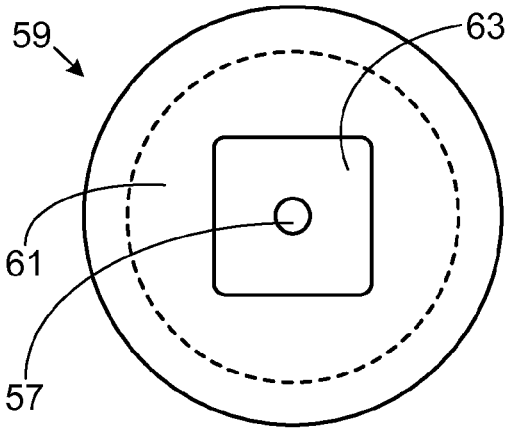
FIG. 49 is a diagram illustrating a transparent top view, in simplified form, of the lower shaft portion connector of FIG. 48.
Figure 50:
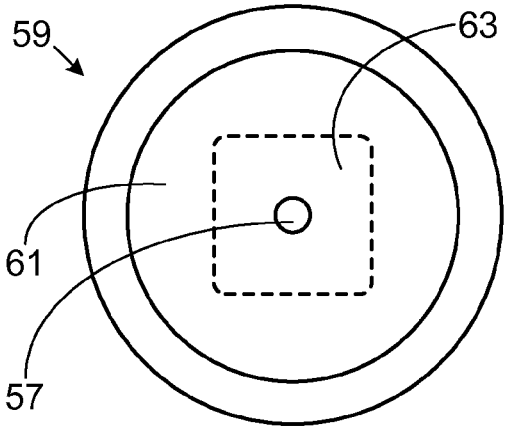
FIG. 50 is a diagram illustrating a transparent bottom view, in simplified form, of the lower shaft portion connector of FIG. 48.
Figure 51:
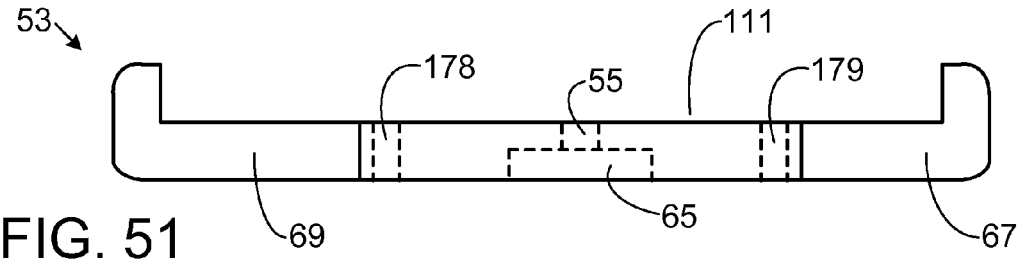
FIG. 51 is a diagram illustrating a standalone transparent plan view, in simplified form, of the rail travel distance limiter of FIG. 47.
Figure 52:
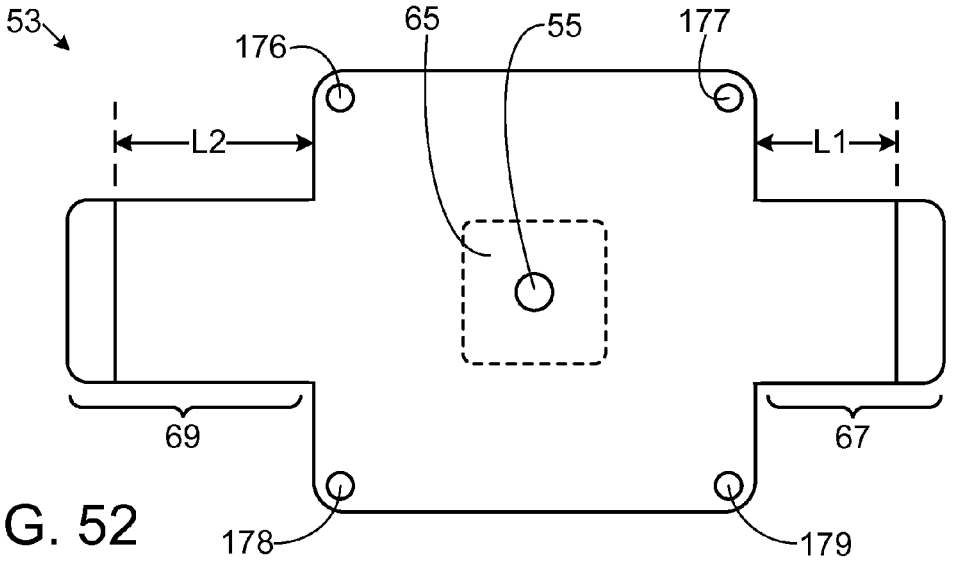
FIG. 52 is a diagram illustrating a transparent top view, in simplified form, of the rail travel distance limiter of FIG. 51.
Figure 53:
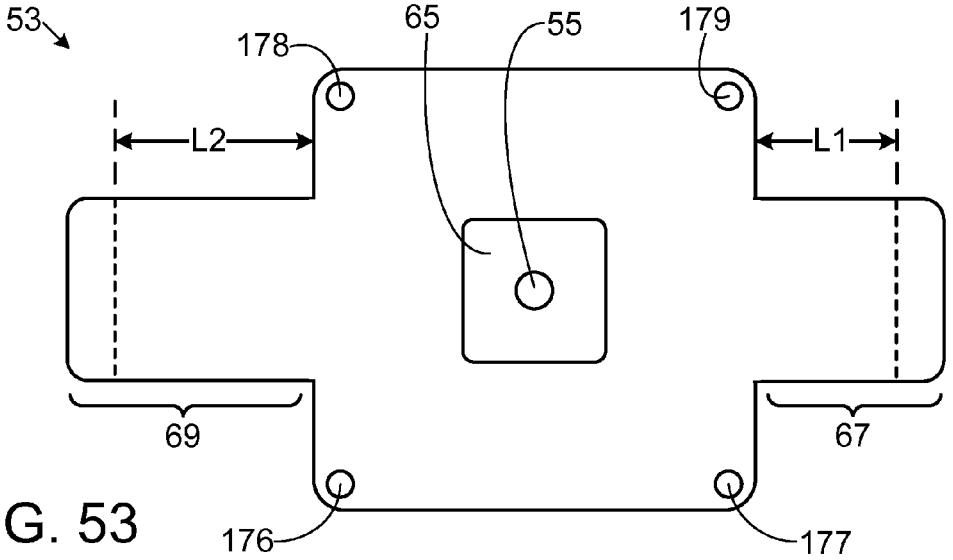
FIG. 53 is a diagram illustrating a transparent bottom view, in simplified form, of the rail travel distance limiter of FIG. 51.

FIG. 47 illustrates an exploded plan view, in simplified form, of yet another embodiment of the lower connector of the slide mechanism of FIG. 8 that is made up of three separate components, namely a rail travel distance limiter 53 and a lower shaft portion connector 59 that are bolted together using a screw 75. FIG. 47 also illustrates how the rail travel distance limiter 53 is bolted to the rail guide block 56 of FIG. 8 using additional screws (e.g., 114 and 116). FIG. 48 illustrates a standalone transparent plan view, in simplified form, of the lower shaft portion connector 59 of FIG. 47. FIG. 49 illustrates a transparent top view, in simplified form, of the lower shaft portion connector 59 of FIG. 48. FIG. 50 illustrates a transparent bottom view, in simplified form, of the lower shaft portion connector 59 of FIG. 48. FIG. 51 illustrates a standalone transparent plan view, in simplified form, of the rail travel distance limiter 53 of FIG. 47. FIG. 52 illustrates a transparent top view, in simplified form, of the rail travel distance limiter 53 of FIG. 51. FIG. 53 illustrates a transparent bottom view, in simplified form, of the rail travel distance limiter 53 of FIG. 51.

As exemplified in FIGS. 48-50 and referring again to FIG. 8, the lower portion of the lower shaft portion connector 59 is adapted to permit the upper end of the lower portion 22 of the golf club shaft to be rigidly connected to the bottom of the connector 59 in a manner that insures this upper end 22 is substantially coaxial with the connector 59. In the lower shaft portion connector embodiment exemplified in FIGS. 48-50 this adaptation is configured as follows. The bottom end of the lower shaft portion connector 59 includes a cylindrical cavity 61 that is substantially coaxial with the connector 59. This cavity 61 has a diameter that is sized to permit the upper end of the lower portion 22 to be snugly inserted upward into the cavity 61 while the strong adhesive is used to rigidly adhere the radially outer surface of this upper end 22 to the radial wall of the cavity 61.

As exemplified in FIGS. 47-53, the upper portion of the lower shaft portion connector 59 is adapted to permit it to be rigidly connected to the bottom surface of the rail travel distance limiter 53 in a manner that insures the longitudinal axis Y7 of the cylindrical cavity 61 is substantially perpendicular to this bottom surface, thus insuring that the longitudinal axis of the upper end of the lower portion 22 of the golf club shaft is substantially perpendicular to this bottom surface when this upper end 22 is connected to the bottom of the connector 59. In the exemplary lower shaft portion connector and rail travel distance limiter embodiments described herein this adaptation is configured as follows. The rail travel distance limiter 53 is bolted by the screw 75 which is inserted through an aperture 55 that passes horizontally through the rail travel distance limiter 53 and into a mating threaded aperture 57 that is located on the top of the lower shaft portion connector 59. The lower shaft portion connector 59 includes an alignment feature 63 that is centrally, rigidly disposed onto the top surface of the connector 59. The rail travel distance limiter 53 includes an alignment cavity 65 that is adapted to fully mate with the alignment feature 63. In other words, the alignment cavity 65 is adapted to snugly receive the entire alignment feature 63 when the rail travel distance limiter 53 is bolted to the lower shaft portion connector 59.

As exemplified in FIGS. 22-25 and 47-53, and referring again to FIGS. 8 and 26, the lower portion of the rail guide block 56 is adapted to permit it to be rigidly connected to the center top surface 111 of the rail travel distance limiter 53 in a manner that insures the longitudinal axis Y7 of the cylindrical cavity 61 (and thus the elongated axis of the upper end of the lower portion 22 of the golf club shaft that is inserted into this cavity 61) is substantially perpendicular to the opposing rail travel features 104 and 106 of the rail guide block 56. In the exemplary rail guide block and rail travel distance limiter embodiments described herein this adaptation is configured as follows. The rail travel distance limiter 53 is bolted by a plurality of screws (e.g., 114 and 116) that are inserted through apertures 176-179 that pass horizontally through the rail travel distance limiter 53 and into the mating threaded apertures 122-125 that are located on the bottom of the rail guide block 56. The rail travel distance limiter 53 includes a pair of opposing rail travel distance limiting features 67 and 69 that are adapted to limit the travel of the sliding rail 52 in the same manner as the rail travel distance limiting features 60 and 62 on the lower connector 58.

Figure 54:
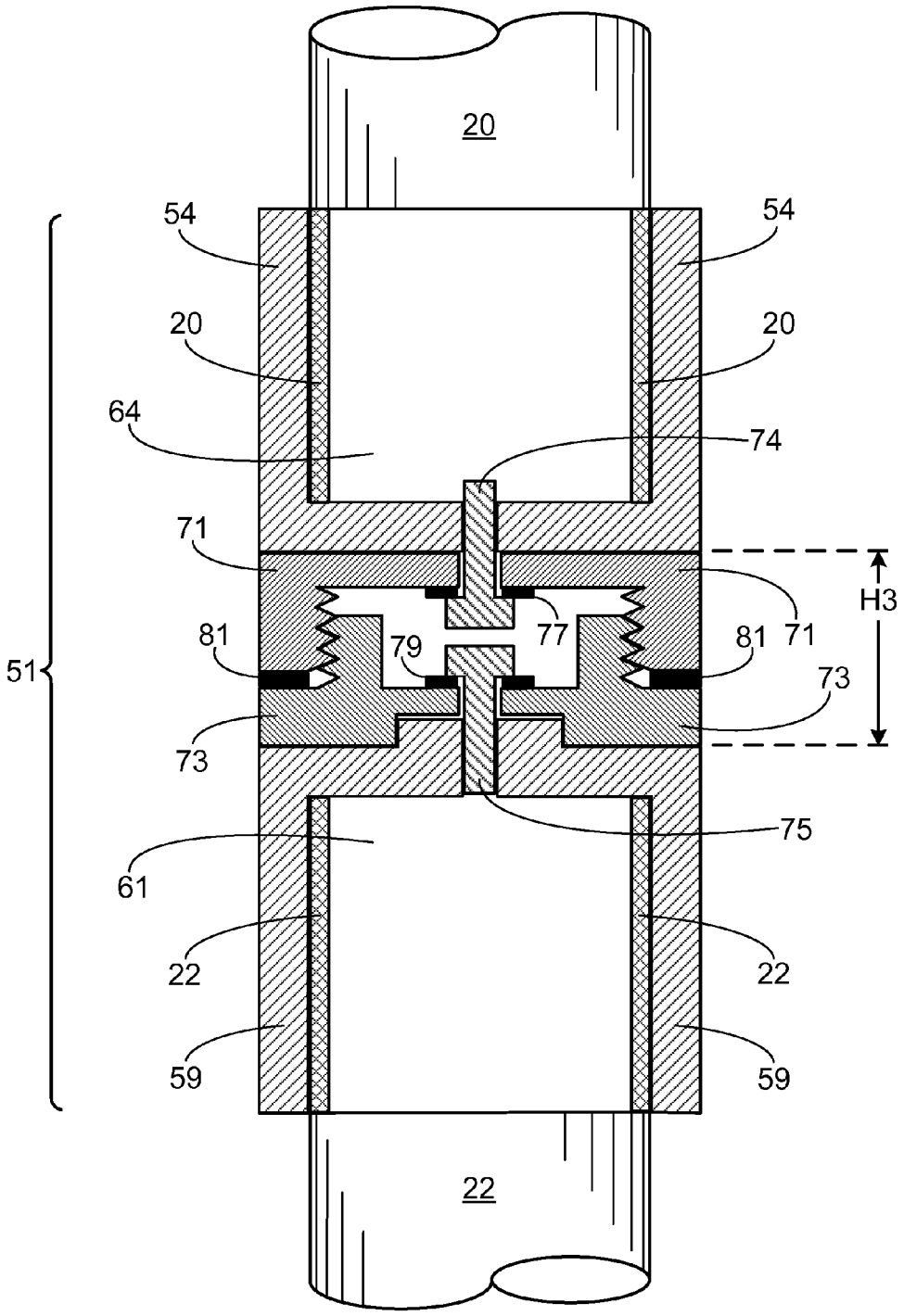
FIG. 54 is a diagram illustrating a partly cross-sectional and partly plan view, in simplified form, of an exemplary embodiment of a convertible slide mechanism that has been converted into a non-sliding mechanism which maintains the upper end of the lower portion of the golf club shaft in substantial coaxial alignment with the lower end of the upper portion of the shaft at all times.

FIG. 54 illustrates a partly cross-sectional and partly plan view, in simplified form, of an exemplary embodiment of a convertible slide mechanism 51 that has been converted into a non-sliding mechanism which maintains the upper end of the lower portion 22 of the golf club shaft in substantial coaxial alignment with the lower end of the upper portion 20 of the shaft at all times. The convertible slide mechanism 51 exemplified in FIG. 54 assumes that the lower end of the upper portion 20 has been rigidly connected to the top of the upper connector 54, and the upper end of the lower portion 22 has been rigidly connected to the bottom of the lower shaft portion connector 59, as described heretofore. The convertible slide mechanism 51 further assumes that the sliding rail 52 has been unbolted and removed from the bottom of the upper connector 54, and in its place an upper conversion member 71 has been bolted onto the bottom of the upper connector 54 using the same screw 74 that was used to bolt the sliding rail 52 to the upper connector 54. A lock-washer 77 can optionally be disposed onto the threaded shaft of the screw 74 before this bolting is performed. The convertible slide mechanism 51 yet further assumes that the rail travel distance limiter 53, and thus the rail guide block 56 that is bolted thereto, have been unbolted and removed from the top of the lower shaft portion connector 59, and in their place a lower conversion member 73 has been bolted onto the top of the lower shaft portion connector 59 using the same screw 75 that was used to bolt the rail travel distance limiter 53 to the lower shaft portion connector 59. Another lock-washer 79 can optionally be disposed onto the threaded shaft of the screw 75 before this bolting is performed.

As exemplified in FIG. 54, a radially externally threaded upper portion of the lower conversion member 73 is adapted to permit it to be threadably connected to a radially internally threaded lower portion of the upper conversion member 71 in a manner that insures these two conversion members 73 and 71 are removably rigidly interconnected and are coaxial when this connection is made. Accordingly, after the upper conversion member 71 has been bolted onto the bottom of the upper connector 54 and the lower conversion member 73 has been bolted onto the top of the lower shaft portion connector 59 as just described, the lower conversion member 73 can be threadably connected to the upper conversion member 71, where the lower conversion member 73 is axially rotated until it is tightened to the upper conversion member 71. In an exemplary embodiment of the convertible slide mechanism 51 described herein the threads on both the lower and upper conversion members 73 and 71 are formed in a counterclockwise arrangement, which is advantageous since it results in the interconnection between the lower and upper conversion members 73 and 71 remaining tight when the golf club is swung by a golfer. A lock-washer 81 can optionally be disposed onto radially externally threaded upper portion of the lower conversion member 73 before this connection is performed. When the lower conversion member 73 is fully tightened into the upper conversion member 71, the interconnected lower and upper conversion members 73 and 71 and the lock-washer 81 that is sandwiched there-between have a combined height H3 that is equal to the combined height of the sliding rail 52, the rail guide block 56 and the rail travel distance limiter 53 when the sliding rail 52 is slidably inserted into the linear guide channel of the rail guide block 56 and the rail travel distance limiter 53 is bolted to the rail guide block 56.

Figure 55:
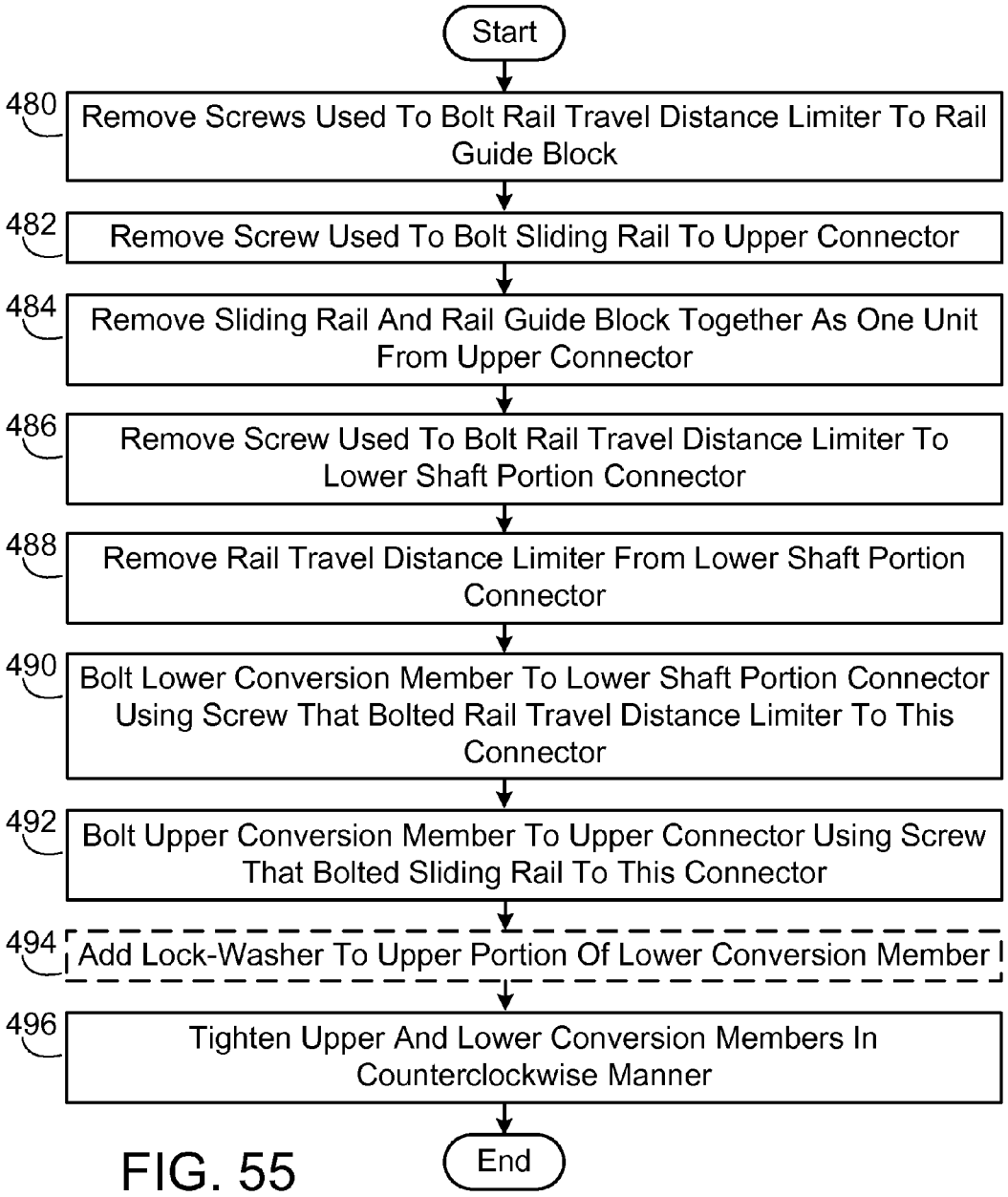
FIG. 55 is a flow diagram illustrating an exemplary embodiment, in simplified form, of a method for converting the convertible slide mechanism from a sliding mechanism into the non-sliding mechanism.

FIG. 55 illustrates an exemplary embodiment, in simplified form, of a method for converting the convertible slide mechanism described herein from a sliding mechanism (that permits a lateral shift of the upper end of the lower portion 22 of the golf club shaft relative to the lower end of the upper portion 20 of the shaft) into the just-described non-sliding mechanism. As exemplified in FIG. 55 the method starts with removing the screws that are used to bolt the rail travel distance limiter to the rail guide block (action 480). The screw that is used to bolt the sliding rail to the upper connector is then removed (action 482). The sliding rail and rail guide block are then removed together as one unit from the upper connector (action 484). The screw that is used to bolt the rail travel distance limiter to the lower shaft portion connector is then removed (action 486). The rail travel distance limiter is then removed from the lower shaft portion connector (action 488). The lower conversion member is then bolted to the lower shaft portion connector using the same screw that bolted the rail travel distance limiter to this connector (action 490). The upper conversion member is then bolted to the upper connector using the same screw that bolted the sliding rail to this connector (action 492). The lock-washer is then optionally added to the upper portion of the lower conversion member (action 494). The upper and lower conversion members are then tightened in a counterclockwise manner (action 496).

3.0 Counterweight Member

Figure 39:
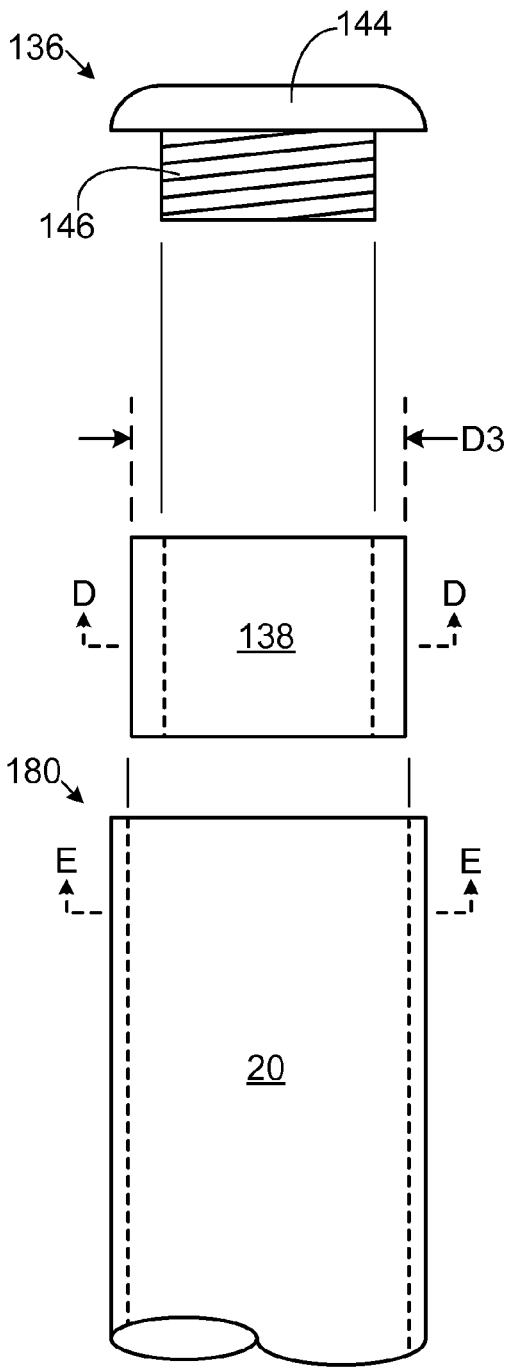
FIG. 39 is a diagram illustrating an exploded plan view, in simplified form, of an exemplary embodiment of a counterweight member that can optionally be connected to the butt end of the golf club shaft via a bushing that is inserted thereinto.
Figure 40:
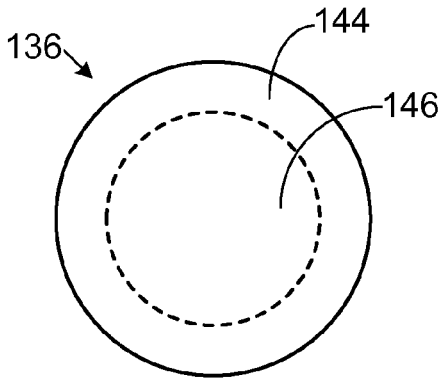
FIG. 40 is a diagram illustrating a standalone transparent top view, in simplified form, of the counterweight member shown in FIG. 39.
Figure 41:
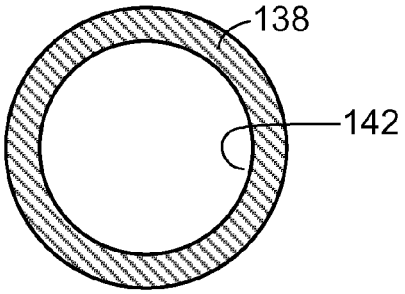
FIG. 41 is a diagram illustrating a cross-sectional view, in simplified form, of the bushing shown in FIG. 39 taken along line D-D of FIG. 39.
Figure 42:
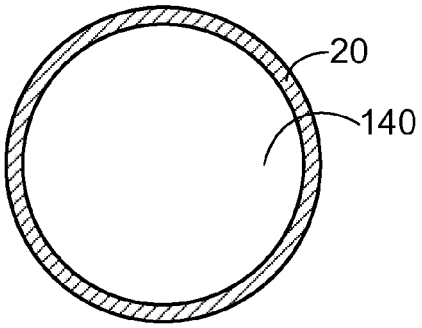
FIG. 42 is a diagram illustrating a cross-sectional view, in simplified form, of the butt end of the golf club shaft shown in FIG. 39 taken along line E-E of FIG. 39.

Generally speaking, FIGS. 39-42 illustrate an exemplary embodiment, in simplified form, of a counterweight member that can optionally be connected to the butt end of the golf club shaft via a bushing that is inserted there-into. More particularly, FIG. 39 illustrates an exploded plan view, in simplified form, of the counterweight member 136 that can be connected to the butt end 180 of the golf club shaft portion 20 via an internally threaded bushing 138 that is inserted there-into. FIG. 40 illustrates a standalone transparent top view, in simplified form, of the counterweight member 136 shown in FIG. 39. FIG. 41 illustrates a cross-sectional view, in simplified form, of the internally threaded bushing 138 shown in FIG. 39 taken along line D-D of FIG. 39. FIG. 42 illustrates a cross-sectional view, in simplified form, of the shaft portion 20 shown in FIG. 39 taken along line E-E of FIG. 39. As exemplified in FIGS. 39-42, the bushing 138 has a radially exterior diameter D3 that is sized to permit the bushing 138 to be retainably inserted (e.g., press fit) into the interior 140 of the butt end 180 of the shaft portion 20 such that the bushing 138 is adhered to the radially inner wall thereof. The interior radial wall 142 of the bushing 138 is threaded. The counterweight member 136 includes a head 144 and a short threaded shaft 146 that is adapted to be threadably connected to the threaded interior radial wall 142 of the bushing 138. One end of the threaded shaft 146 is rigidly disposed onto the bottom of the head 144. The other end of the threaded shaft 146 is rotatably and threadably connected to the interior radial wall 142 of the bushing 138. The counterweight member 136 can be screwed into the bushing 138 until the bottom of the head 144 makes contact with the butt end 180.

Referring again to FIGS. 1, 8 and 39, it will be appreciated that the counterweight member 136 and its associated bushing 138 can be used in conjunction with either the slide mechanism 18 or the modified slide mechanism 50 embodiments described herein. Usage of the counterweight member 136 and bushing 138 are advantageous since they serve to counter-balance the weight of the slide mechanism 18/50 after it has been interposed into the golf club shaft, thus making the golf club feel less head-end heavy to the golfer. In other words, the counterweight member 136 and bushing 138 serve to recreate the original balance point of the club after the slide mechanism 18/50 has been interposed into the shaft. The counterweight member 136 can have various different weights, where the particular weight that is chosen depends on various factors such as the type of golf club the slide mechanism 18/50 is being interposed into, the weight of the golf club, the particular location along the shaft where the slide mechanism 18/50 is interposed, and the weight of the slide mechanism 18/50 (among other factors). In an exemplary embodiment of the training apparatus described herein the counterweight member 136 can have any weight that is greater than or equal to three grams and less than or equal to 53 grams.

4.0 Axial Alignment Apparatus

Figure 34:
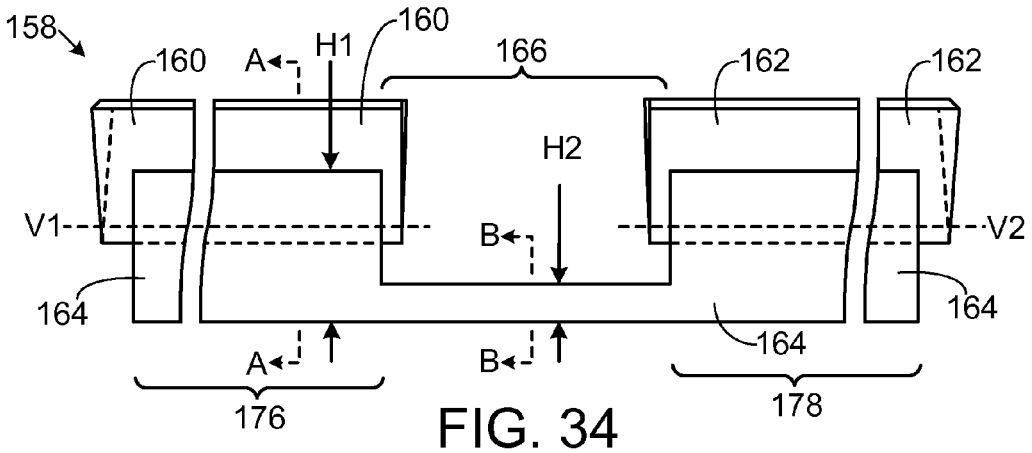
FIG. 34 is a diagram illustrating a standalone transparent plan view, in simplified form, of an exemplary embodiment of an axial alignment apparatus that can be used during the fabrication of the golf club swing training apparatus described herein.
Figure 35:
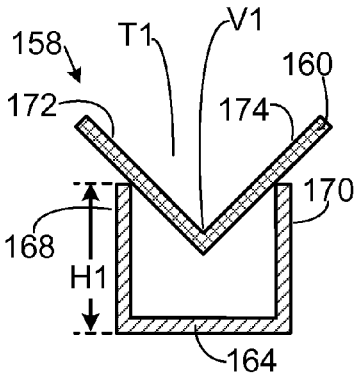
FIG. 35 is a diagram illustrating a cross-sectional view, in simplified form, of the axial alignment apparatus taken along line A-A of FIG. 34.
Figure 36:
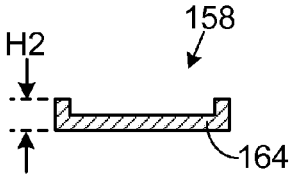
FIG. 36 is a diagram illustrating a cross-sectional view, in simplified form, of the axial alignment apparatus taken along line B-B of FIG. 34.

FIGS. 34-36 illustrate an exemplary embodiment, in simplified form, of an axial alignment apparatus that can be used during the fabrication of the golf club swing training apparatus described herein. More particularly, FIG. 34 illustrates a standalone transparent plan view, in simplified form, of an exemplary embodiment of the axial alignment apparatus 158. FIG. 35 illustrates a cross-sectional view, in simplified form, of the apparatus 158 taken along line A-A of FIG. 34. FIG. 36 illustrates a cross-sectional view, in simplified form, of the apparatus 158 taken along line B-B of FIG. 34. As will be described in more detail hereafter and referring again to FIG. 8, the apparatus 158 can be used to maintain the elongated axis of the upper portion 20 of the golf club shaft in substantial alignment with the elongated axis of the lower portion 22 of the golf club shaft when the modified slide mechanism 50 is being connected to the upper portion of 22 and the lower portion of 20.

As exemplified in FIGS. 34-36, the axial alignment apparatus 158 includes a channel beam 164 having a pair of flanges 168 and 170, a left-side L-beam 160 having an elongated vertex V1 and forming one elongated trough T1, and a right-side L-beam 162 having an elongated vertex V2 and forming another elongated trough, where the channel beam 164 serves as the base of the apparatus 158. As is appreciated in the art of manufacturing materials, an L-beam is a beam having an L-shaped cross section, and thus is also known as an L-section beam. In the apparatus embodiment exemplified in FIG. 35 the left-side L-beam 160 is a square L-beam whose two legs (e.g., tabs) 172 and 174 have the same width. An alternate embodiment (not shown) of the axial alignment apparatus is also possible where the left side L-beam can be a rectangular L-beam whose two legs have different widths. Similarly, the right-side L-beam 162 can be either square or rectangular. In the apparatus embodiment exemplified in FIG. 35 the channel beam 164 is a U-beam whose flanges 168 and 170 have a common height H1. Alternate embodiments (not shown) of the axial alignment apparatus are also possible where the channel beam can be an I-beam (among other types of beams), and where the flanges of the channel beam can have different heights.

Referring again to FIGS. 34-36, the channel beam 164 includes a cutout section 166 in which the flanges 168 and 170 have a reduced height (e.g., the flanges 168 and 170 have a height H2 that is substantially less than height H1). Generally speaking, the left-side L-beam 160 is rigidly disposed onto the top edge of the channel beam's 164 flanges 168 and 170 to the left of the cutout section 166 such that the elongated trough T1 faces upward. The right-side L-beam 162 is rigidly disposed onto this top edge to the right of the cutout section 166 such that the other elongated trough faces upward and the elongated vertex V2 of the right-side L-beam 162 is substantially aligned with elongated vertex V1 of the left-side L-beam 160. More particularly and as exemplified in FIGS. 34 and 35, one of the legs 172 of the left-side L-beam 160 is rigidly disposed onto the top edge of the left-hand portion 176 of one of the channel beam's 164 flanges 168, and the other of the legs 174 of the left-side L-beam 160 is rigidly disposed onto the top edge of the left-hand portion 176 of the other of the channel beam's 164 flanges 170. Similarly, one of the legs of the right-side L-beam 162 is rigidly disposed onto the top edge of the right-hand portion 178 of one of the channel beam's 164 flanges 168, and the other of the legs of the right-side L-beam 162 is rigidly disposed onto the top edge of the right-hand portion 178 of the other of the channel beam's 164 flanges 170.

Figure 38:
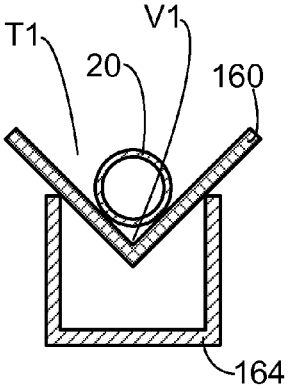
FIG. 38 is a diagram illustrating a cross-sectional view, in simplified form, of the diagram shown in FIG. 37 taken along line C-C of FIG. 37.
Figure 37:
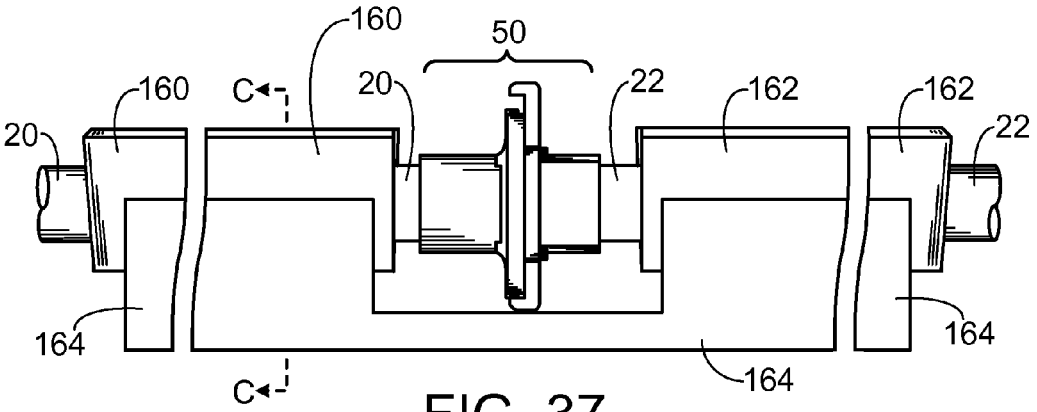
FIG. 37 is a diagram illustrating a plan view, in simplified form, of an exemplary embodiment of the axial alignment apparatus being used to connect the upper and lower portions of the golf club shaft to the slide mechanism of FIG. 8.

FIG. 37 illustrates a plan view, in simplified form, of an exemplary embodiment of the axial alignment apparatus 158 of FIG. 34 being used to connect the upper and lower portions 20 and 22 of the golf club shaft to the modified slide mechanism 50 of FIG. 8. FIG. 38 illustrates a cross-sectional view, in simplified form, of the diagram shown in FIG. 37 taken along line C-C of FIG. 37. As exemplified in FIGS. 37 and 38 and referring again to FIG. 34, the upper portion 20 of the golf club shaft is placed into the elongated trough T1 of the left-side L-beam 160, the lower portion 22 of the golf club shaft is placed into the other elongated trough of the right-side L-beam 162, and the slide mechanism 50 is placed into the cutout section 166 of the channel beam 164.

Figure 45:
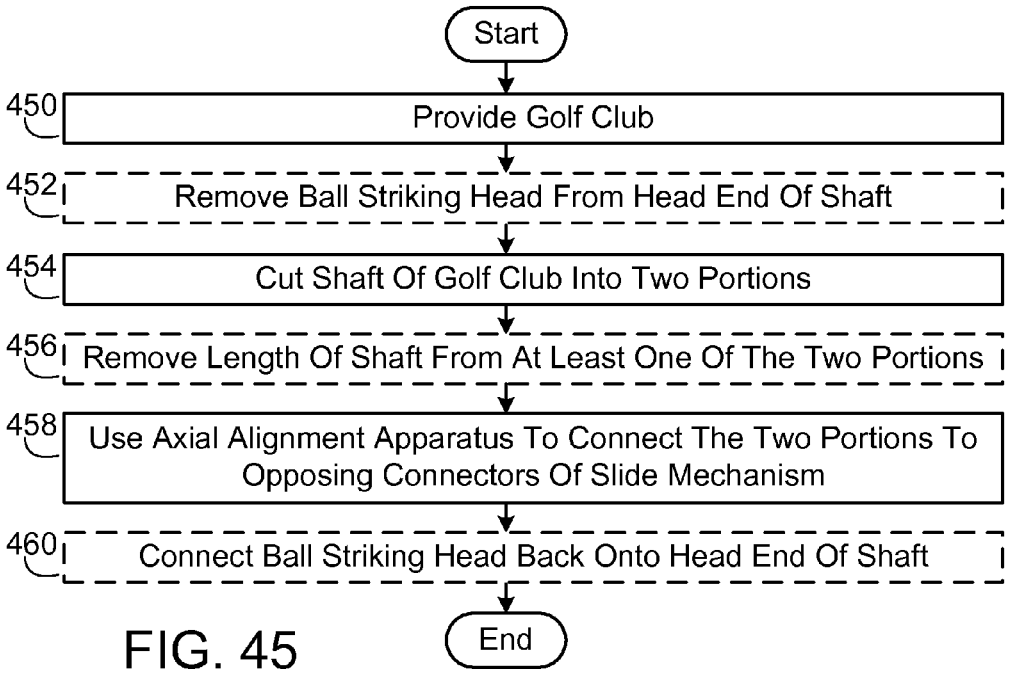
FIG. 45 is a flow diagram illustrating an exemplary embodiment, in simplified form, of a method for fabricating the golf club swing training apparatus described herein.

FIG. 45 illustrates an exemplary embodiment, in simplified form, of a method for fabricating the golf club swing training apparatus described herein. As exemplified in FIG. 45 the methods starts with providing a golf club that includes a shaft having a butt end and a head end (action 450), where the head end is affixed to a ball striking head. In order to make the fabrication of the training apparatus easier and more accurate, the ball striking head can optionally then be removed from the head end of the shaft (action 452). The shaft is then cut into two portions (action 454), namely an upper portion that includes the butt end and a lower portion that includes the head end. A length of shaft can then optionally be removed from at least one of the two portions (action 456), where this length is selected so that the length of the shaft after the two portions have been connected to opposing connectors of the slide mechanism equals the original length of the shaft before it is cut. The axial alignment apparatus is then used to connect the two portions to the opposing connectors of the slide mechanism (action 458). In the case where the optional action 452 was performed, the ball striking head is then connected back onto the head end of the shaft (action 460). As described heretofore, the slide mechanism is configured to permit the upper end of the lower portion of the shaft to shift laterally relative to the lower end of the upper portion of the shaft during a swinging of the club to impact a ball with the ball striking head.

5.0 Additional Embodiments

Although particular embodiments have been disclosed herein, those having skill in the art of golf clubs and mechanical interconnect devices will perceive various alternative embodiments which may be utilized to achieve the same function and results. By way of example but not limitation and referring again to FIGS. 10 and 44, the upper connector 54 and sliding rail 52 can be fabricated as a single part, in which case the screw 74 would be unnecessary. A lock-washer (not shown) can also be disposed onto the threaded shaft of each of the screws 74, 75, 114, 116 and 152 before the screw is inserted into its mating threaded aperture.

Figure 15:
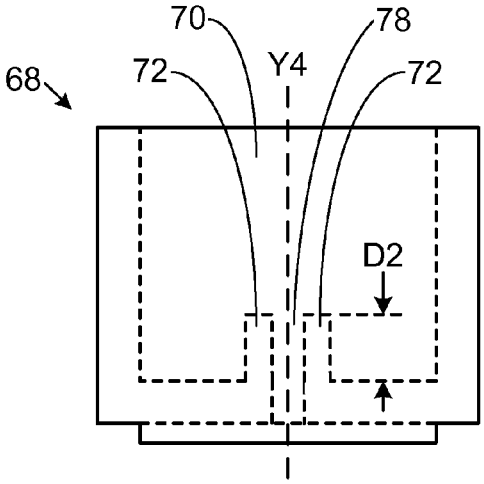
FIG. 15 is a diagram illustrating a standalone transparent plan view, in simplified form, of another embodiment of the upper connector of the slide mechanism of FIG. 8.
Figure 16:
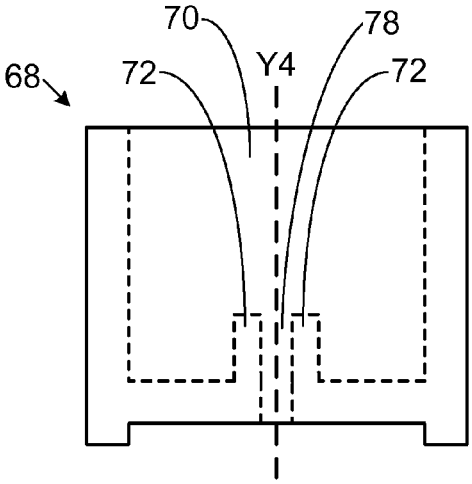
FIG. 16 is a diagram illustrating a transparent plan view, in simplified form, of the upper connector of FIG. 15 rotated left 90 degrees.
Figure 17:
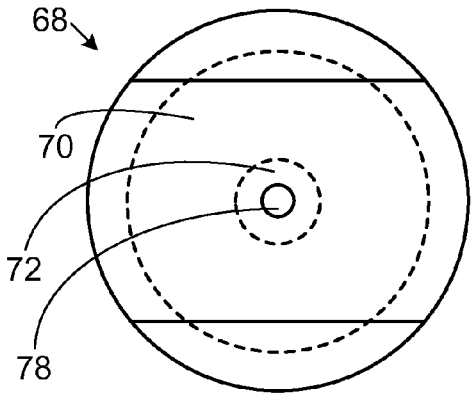
FIG. 17 is a diagram illustrating a transparent bottom view, in simplified form, of the upper connector of FIG. 15.
Figure 18:
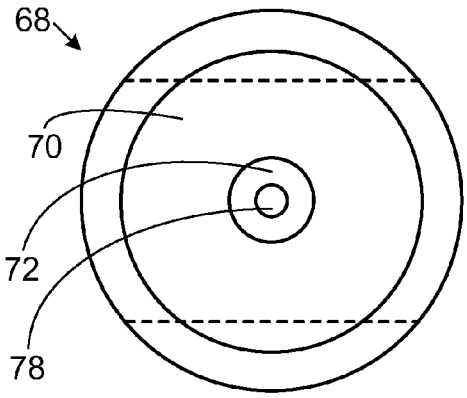
FIG. 18 is a diagram illustrating a transparent top view, in simplified form, of the upper connector of FIG. 15.

FIGS. 15-18 illustrate another embodiment, in simplified form, of the upper connector of the modified slide mechanism 50 of FIG. 8. More particularly, FIG. 15 illustrates a standalone transparent plan view, in simplified form, of another embodiment of the upper connector 68. FIG. 16 illustrates a transparent plan view, in simplified form, of the upper connector 68 of FIG. 15 rotated left 90 degrees. FIG. 17 illustrates a transparent bottom view, in simplified form, of the upper connector 68 of FIG. 15. FIG. 18 illustrates a transparent top view, in simplified form, of the upper connector 68 of FIG. 15. As exemplified in FIGS. 15-18, the upper portion of the upper connector 68 is adapted to permit the lower end of the upper portion 20 of the golf club shaft to be rigidly connected to the top of the connector 68 in a manner that insures this lower end 20 is substantially coaxial with the connector 68. In the upper connector embodiment exemplified in FIGS. 15-18 this adaptation is configured as follows. The top end of the upper connector 68 includes a cylindrical cavity 70 that is substantially coaxial with the connector 68. This cavity 70 has a diameter that is sized to permit the lower end of the upper portion 20 to be snugly inserted downward into the cavity 70. The upper connector 68 also includes a tube 72 that protrudes upward a prescribed distance D2 from the bottom of the cavity 70 and is also substantially coaxial with the connector 68. The lower end of the upper portion 20 of the golf club shaft is rigidly connected to the top of the upper connector 68 by using the aforementioned strong adhesive to rigidly adhere the radially outer surface of this lower end 20 to the radial wall of the cavity 70, and also using the adhesive to rigidly adhere the radially inner surface of this lower end 20 to the radially outer surface of the tube 72. It will be appreciated that using the adhesive to rigidly adhere the lower end of the upper portion 20 to both the radial wall of the cavity 70 and the radially outer surface of the tube 72 is advantageous since it further increases the strength of the bond between this lower end 20 and the slide mechanism 50. The lower portion of the upper connector 68 is adapted to permit it to be rigidly connected to a central position on the top surface 66 of the sliding rail 52 in a manner that insures the longitudinal axis Y4 of the cylindrical cavity 70 is substantially perpendicular to the surface 66. More particularly, the sliding rail 52 can be bolted by a screw 74 into a mating threaded aperture 78 that is located on the bottom of the upper connector 68.

Figure 30:
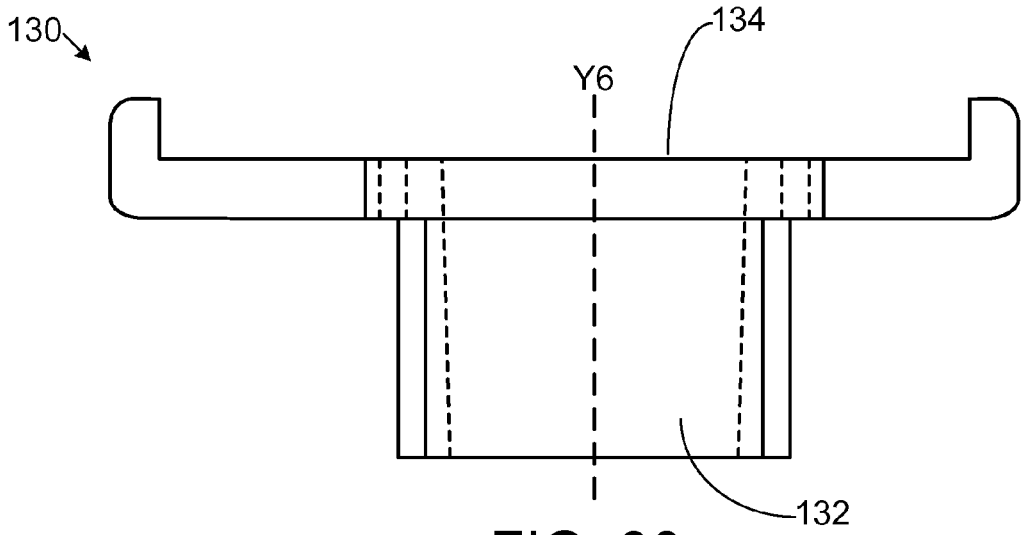
FIG. 30 is a diagram illustrating a standalone transparent plan view, in simplified form, of another embodiment of the lower connector of the slide mechanism of FIG. 8.
Figure 31:
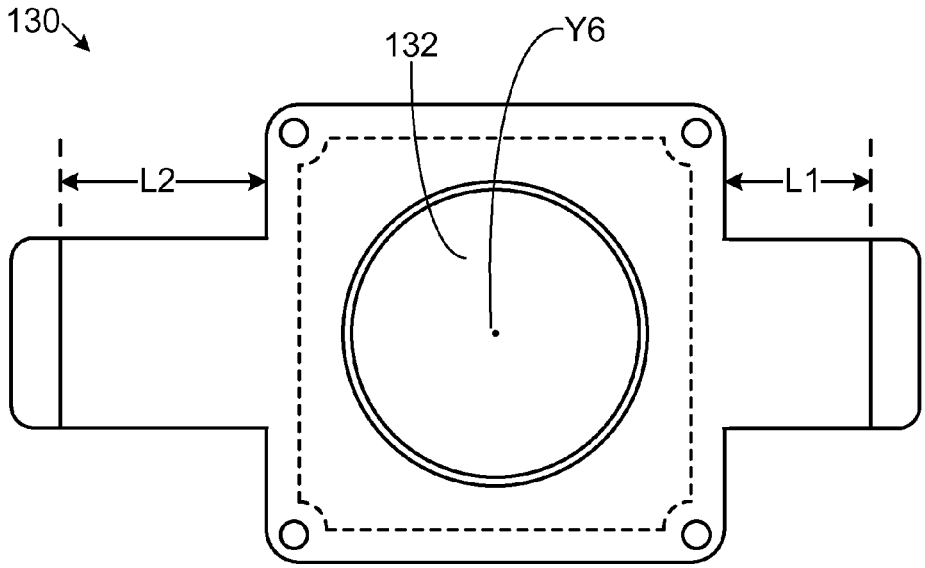
FIG. 31 is a diagram illustrating a transparent top view, in simplified form, of the lower connector of FIG. 30.
Figure 32:
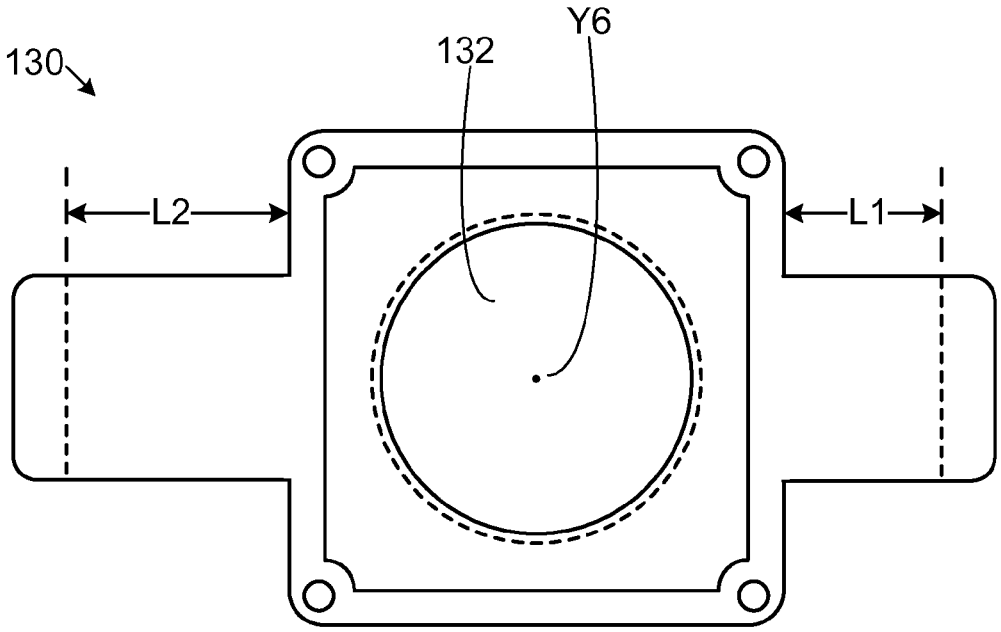
FIG. 32 is a diagram illustrating a transparent bottom view, in simplified form, of the lower connector of FIG. 30.
Figure 33:
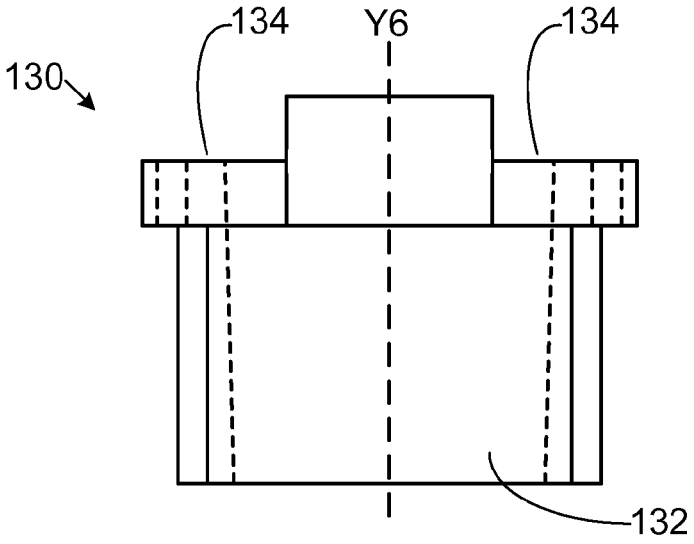
FIG. 33 is a diagram illustrating a transparent plan view, in simplified form, of the lower connector of FIG. 30 rotated left 90 degrees.

FIGS. 30-33 illustrate another embodiment, in simplified form, of the lower connector of the modified slide mechanism 50 of FIG. 8. More particularly, FIG. 30 illustrates a standalone transparent plane view, in simplified form, of another embodiment of the lower connector 130. FIG. 31 illustrates a transparent top view, in simplified form, of the lower connector 130 of FIG. 30. FIG. 32 illustrates a transparent bottom view, in simplified form of the lower connector 130 of FIG. 30. FIG. 33 illustrates a transparent plan view, in simplified form, of the lower connector 130 of FIG. 30 rotated left 90 degrees. As exemplified in FIGS. 30-33, the lower portion of the lower connector 130 is adapted to permit the upper end of the lower portion 22 of the golf club shaft to be rigidly connected to the bottom of the connector 130 in a manner that insures the elongated axis of this upper end 22 is substantially perpendicular to the center top surface 134 of the connector 130. In the lower connector embodiment exemplified in FIGS. 30-33 this adaptation is configured as follows. The bottom end of the lower connector 130 includes a truncated conical cavity 132 having a longitudinal axis Y6 that is substantially perpendicular to the center top surface 134 of the connector 130, and having a diameter that tapers radially inward slightly as the cavity progresses downward. This diameter is selected so that the shape and size of the cavity 132 substantially match the exterior shape and size of the upper end of the lower portion 22, and so that when the lower portion 22 is fully inserted downward into the cavity 132 while the aforementioned strong adhesive is used to rigidly adhere the radially outer surface of this upper end to the radial wall of the cavity 132, the top of this upper end is either flush with or slightly beneath the center top surface 134. It will be appreciated that the just-described slight inward tapering of the diameter of the cavity 132 is advantageous since it helps to prevent the lower portion 22 of the golf club shaft from sliding out of the lower connector 130 in the event that the adhesive loses its bond.

Figure 43:
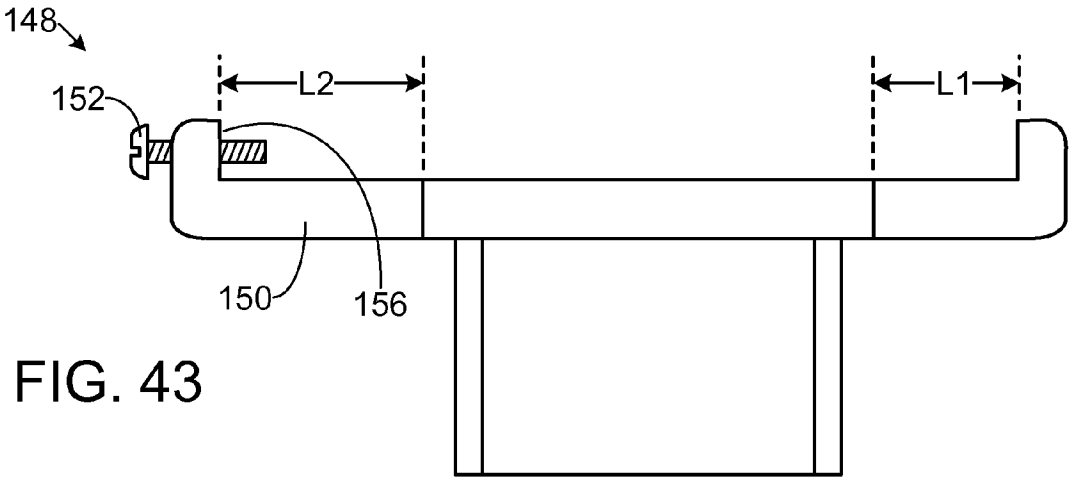
FIG. 43 is a diagram illustrating a standalone plan view, in simplified form, of yet another embodiment of the lower connector of the slide mechanism of FIG. 8.
Figure 44:
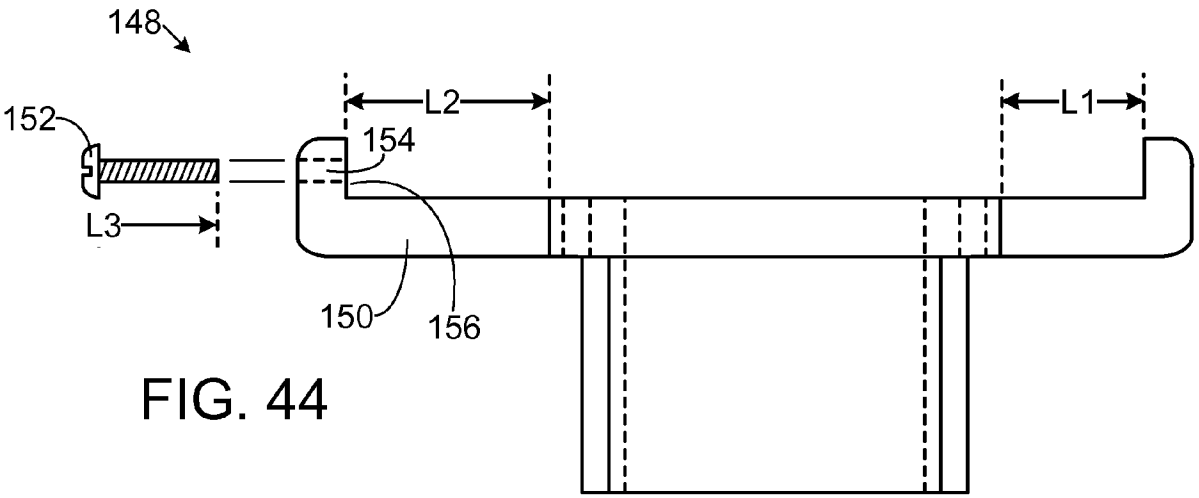
FIG. 44 is a diagram illustrating an exploded transparent plan view, in simplified form, of the lower connector of FIG. 43.

FIGS. 43 and 44 illustrate yet another embodiment, in simplified form, of the lower connector of the modified slide mechanism 50 of FIG. 8. More particularly, FIG. 43 illustrates a standalone plan view, in simplified form, of yet another embodiment of the lower connector 148. FIG. 44 illustrates an exploded transparent plan view, in simplified form, of the lower connector 148 of FIG. 43. Generally speaking, the lower connector 148 includes a rail travel distance limiting screw 152 that is adapted to permit the golfer to selectively reduce the aforementioned maximum rail travel distance D1. More particularly, and as exemplified in FIGS. 43 and 44 and referring again to FIGS. 8 and 9, the left-side rail travel distance limiting feature 150 of the lower connector 148 includes the rail travel distance limiting screw 152 which can be rotatably and threadably connected to a mating threaded aperture 154 that is substantially perpendicular to and passes through the inner vertical wall 156 of this feature 150. The screw 152 has a length L3 that is generally sufficient to permit the right end of the screw 152 to be rotatably positioned either to the left of the wall 156 or at various prescribed points to the right of the wall 156. As such, the screw 152 can be used by the golfer to selectively reduce the distance D1. In an exemplary implementation of the lower connector 148 the length L3 of the screw 152 is sufficient to permit the right end thereof to make contact with the left side of the sliding rail 52 when it is situated in the aforementioned right-most position as exemplified in FIG. 8, thus permitting the golfer to reduce the distance D1 to zero. Accordingly, the screw 152 can be used to completely disable the lateral shift of the upper end of the lower portion 22 of the golf club shaft relative to the lower end of the upper portion 20 of the golf club shaft. In other words, the screw 152 can be used to prevent the lateral shift of this upper end 22 relative to this lower end 20 and maintain the upper end 22 in substantial coaxial alignment with the lower end 20 at all times regardless of how the golfer swings the golf club.

It is noted that any or all of the aforementioned embodiments can be used in any combination desired to form additional hybrid embodiments. Although the particular embodiments disclosed herein have been described in language specific to structural features and/or methodological acts, it is to be understood that the subject matter defined in the appended claims is not necessarily limited to the specific features or acts described heretofore. Rather, the specific features and acts described heretofore are disclosed as example forms of implementing the claims.

Wherefore, what is claimed is:

1. A golf club swing training apparatus, comprising:

a golf club shaft having a butt end and a head end, the shaft comprising two separate and distinct portions spaced apart to form a gap there-between, said portions comprising an upper shaft portion comprising the butt end of the shaft and a lower shaft portion comprising the head end of the shaft;

a ball striking head connected to the head end of the shaft; and a slide mechanism inserted within said gap and connected to the lower end of the upper shaft portion and the upper end of the lower shaft portion, the slide mechanism comprising an upper connector, a sliding rail, a rail guide block, and a lower connector that are configured to permit a lateral shift of said upper end relative to said lower end during a swinging of the club.

2. The apparatus of claim 1, wherein, the upper portion of the upper connector is adapted to permit said lower end to be connected to the top of the upper connector in a manner that insures said lower end is substantially coaxial with the upper connector, and the lower portion of the upper connector is adapted to permit it to be connected to a central position on the top surface of the sliding rail in a manner that insures the longitudinal axis of said lower end is substantially perpendicular to said top surface.

3. The apparatus of claim 2, wherein the adaptation of the upper portion of the upper connector comprises the top end of the upper connector comprising a cylindrical cavity that is substantially coaxial with the upper connector, said cavity having a diameter that is sized to permit said lower end to be snugly inserted into said cavity while an adhesive is used to adhere the radially outer surface of said lower end to the radial wall of said cavity.

4. The apparatus of claim 3, wherein the adaptation of the upper portion of the upper connector further comprises the upper connector comprising a tube that protrudes upward from the bottom of said cavity and is also substantially coaxial with the upper connector, the adhesive also being used to adhere the radially inner surface of said lower end to the radially outer surface of the tube.

5. The apparatus of claim 1, wherein, the upper portion of the rail guide block comprises a linear guide channel comprising a pair of opposing rail travel features, and the lower portion of the sliding rail comprises a pair of opposing elongated rail slots that are adapted to receive said features in sliding engagement when the sliding rail is slidably inserted into said channel.

6. The apparatus of claim 5, wherein the lower portion of the rail guide block is adapted to permit it to be connected to the center top surface of the lower connector in a manner that insures the elongated axis of said upper end is substantially perpendicular to said features, and also insures said lower end and said upper end are substantially coaxial when the sliding rail is situated in a right-most position.

7. The apparatus of claim 1, wherein, the upper portion of the lower connector comprises a pair of opposing rail travel distance limiting features that are adapted to limit said lateral shift to a maximum rail travel distance, and the lower portion of the lower connector is adapted to permit said upper end to be connected to the bottom of the lower connector in a manner that insures the elongated axis of said upper end is substantially perpendicular to the center top surface of the lower connector.

8. The apparatus of claim 7, wherein the opposing rail travel distance limiting features comprise:

a right-side rail travel distance limiting feature comprising a prescribed length L1; and a left-side rail travel distance limiting feature comprising a prescribed length L2 that is greater than length L1, the difference between length L2 and length L1 defining the maximum rail travel distance.

9. The apparatus of claim 7, wherein the adaptation of the lower portion of the lower connector comprises the bottom end of the lower connector comprising a cylindrical cavity having a longitudinal axis that is substantially perpendicular to said center top surface, and having a diameter that is sized to permit said upper end to be snugly inserted into said cavity while an adhesive is used to adhere the radially outer surface of said upper end to the radial wall of said cavity.

10. The apparatus of claim 7, wherein the adaptation of the lower portion of the lower connector comprises the bottom end of the lower connector comprising a truncated conical cavity having a longitudinal axis that is substantially perpendicular to said center top surface, and having a diameter that tapers radially inward as said cavity progresses downward, said diameter being selected so that the shape and size of said cavity substantially match the exterior shape and size of said upper end, and so that when the lower shaft portion is fully inserted downward into said cavity while an adhesive is used to adhere the radially outer surface of said upper end to the radial wall of said cavity, the top of said upper end is either flush with or slightly beneath said center top surface.

11. The apparatus of claim 1, further comprising a counterweight member that is connected to the butt end of the shaft via a bushing that is inserted there-into.

12. The apparatus of claim 1, wherein said lateral shift is limited to a distance of between 0.55 millimeters and 0.75 millimeters.

13. The apparatus of claim 1, wherein said gap is located at a distance from the butt end of the shaft of about 30 percent of the total length of the club.

14. The apparatus of claim 1, wherein the slide mechanism generates a discernible sound upon said lateral shift.

15. The apparatus of claim 1, wherein the slide mechanism generates a tactile sensation at the butt end of the shaft upon said lateral shift.

16. The apparatus of claim 1, wherein, the lower connector comprises a rail travel distance limiter and a lower shaft portion connector, and the slide mechanism further comprises an upper conversion member and a lower conversion member, the upper conversion member being bolted onto the bottom of the upper connector in place of the sliding rail, the lower conversion member being bolted onto the top of the lower shaft portion connector in place of the rail travel distance limiter and the rail guide block, a radially externally threaded upper portion of the lower conversion member being threadably connected to a radially internally threaded lower portion of the upper conversion member, said connection resulting in the slide mechanism being converted into a non-sliding mechanism which maintains said upper end in substantial coaxial alignment with said lower end at all times.

17. The apparatus of claim 16, wherein the threads on the upper portion of the lower conversion member and the threads on the lower portion of the upper conversion member are formed in a counterclockwise arrangement.

18. A golf club swing training apparatus, comprising:

a golf club shaft having a butt end and a head end, the shaft comprising two separate and distinct portions spaced apart to form a gap there-between, said portions comprising an upper shaft portion comprising the butt end of the shaft and a lower shaft portion comprising the head end of the shaft;

a ball striking head connected to the head end of the shaft; and a slide mechanism inserted within said gap and connected to the lower end of the upper shaft portion and the upper end of the lower shaft portion, the slide mechanism comprising an upper connector, a sliding rail, a rail guide block, and a lower connector that are configured to permit a lateral shift of said upper end relative to said lower end during a swinging of the club toward a golf ball, said lateral shift being limited to a maximum rail travel distance, the lower connector comprising a rail travel distance limiting screw that is adapted to permit a golfer to selectively reduce the maximum rail travel distance.

19. The apparatus of claim 18, wherein the length of said screw is sufficient to permit the golfer to reduce the maximum rail travel distance to zero, thus preventing said lateral shift and maintaining said upper end in substantial coaxial alignment with said lower end at all times.

20. A method for fabricating a golf club swing training apparatus, the method comprising the actions of:

providing a golf club comprising a shaft having a butt end and a head end, the head end of the shaft being affixed to a ball striking head;

cutting the shaft into two portions comprising an upper shaft portion comprising the butt end of the shaft and a lower shaft portion comprising the head end of the shaft; and using an axial alignment apparatus to connect said two portions to opposing connectors of a slide mechanism, the axial alignment apparatus being used to maintain the elongated axis of the upper shaft portion in substantial alignment with the elongated axis of the lower shaft portion when said connection is being made, the slide mechanism being configured to permit the upper end of the lower shaft portion to shift laterally relative to the lower end of the upper shaft portion during a swinging of the club to impact a ball with the ball striking head.

21. The method of claim 20, further comprising an action of removing a length of shaft from at least one of said two portions, said length being selected so that the length of the shaft after said two portions have been connected to opposing connectors of the slide mechanism equals the original length of the shaft before it is cut.

22. The method of claim 20, wherein the axial alignment apparatus comprises:

a channel beam comprising a pair of flanges and a cutout section in which said flanges have a reduced height;

a left-side L-beam having an elongated vertex V1 and forming one elongated trough; and a right-side L-beam having an elongated vertex V2 and forming another elongated trough, the left-side L-beam being rigidly disposed onto the top edge of said flanges to the left of the cutout section such that said one elongated trough faces upward, the right-side L-beam being rigidly disposed onto said top edge to the right of the cutout section such that said other elongated trough faces upward and vertex V2 is substantially aligned with vertex V1, the upper shaft portion being placed into said one elongated trough, the lower shaft portion being placed into said other elongated trough, the slide mechanism being placed into the cutout section.

* * * * *